US011353234B2

(12) United States Patent
Tsukiyama et al.

(10) Patent No.: US 11,353,234 B2
(45) Date of Patent: Jun. 7, 2022

(54) AIR CONDITIONING SYSTEM

(71) Applicant: Mitsubishi Electric Corporation, Tokyo (JP)

(72) Inventors: Ryo Tsukiyama, Tokyo (JP); Masahiro Ito, Tokyo (JP); So Nomoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 85 days.

(21) Appl. No.: 16/652,319

(22) PCT Filed: Oct. 13, 2017

(86) PCT No.: PCT/JP2017/037166
§ 371 (c)(1),
(2) Date: Mar. 30, 2020

(87) PCT Pub. No.: WO2019/073591
PCT Pub. Date: Apr. 18, 2019

(65) Prior Publication Data

US 2021/0310686 A1 Oct. 7, 2021

(51) Int. Cl.

| | |
|---|---|
| ***F24F 1/0007*** | (2019.01) |
| ***F24F 11/84*** | (2018.01) |
| ***F24F 11/83*** | (2018.01) |
| ***F24F 11/46*** | (2018.01) |
| ***F24F 11/67*** | (2018.01) |
| ***F24F 1/0059*** | (2019.01) |

(Continued)

(52) U.S. Cl.
CPC ..... *F24F 11/83* (2018.01); *F24F 1/0007* (2013.01); *F24F 1/0059* (2013.01); *F24F 1/20* (2013.01); *F24F 3/06* (2013.01); *F24F 11/46* (2018.01); *F24F 11/67* (2018.01); *F25B 1/00* (2013.01)

(58) Field of Classification Search
CPC ..... F24F 1/00077; F24F 11/84; F24F 13/30; F25B 2313/003; F24D 3/00
See application file for complete search history.

(56) References Cited

U.S. PATENT DOCUMENTS

2012/0018129 A1* 1/2012 Ushijima ..... F24D 3/18 165/104.19
2015/0285519 A1 10/2015 Motomura et al.

FOREIGN PATENT DOCUMENTS

JP 2001147022 A * 5/2001
JP 5855279 B2 2/2016

* cited by examiner

*Primary Examiner* — Lionel Nouketcha
(74) *Attorney, Agent, or Firm* — Posz Law Group, PLC

(57) ABSTRACT

Each of plural temperature adjustment apparatuses variably adjusts the amount of heat exchange between an inflow medium, which is a liquid medium supplied to a corresponding indoor heat exchanger, and an outflow medium, which is a liquid medium discharged from the corresponding indoor heat exchanger. Each of the plural temperature adjustment apparatuses reduces the heat exchanging capacity of the corresponding indoor heat exchanger by increasing the amount of heat exchange between the inflow medium and the outflow medium when the heat exchanging capacity of the corresponding indoor heat exchanger is larger than the indoor load. When there is no temperature adjustment apparatus in which the amount of heat exchange between the inflow medium and the outflow medium is set to the minimum, the heat source apparatus reduces the heating capacity or the cooling capacity for changing the temperature of the liquid medium.

15 Claims, 19 Drawing Sheets

(51) Int. Cl.

| | |
|---|---|
| ***F24F 1/20*** | (2011.01) |
| ***F24F 3/06*** | (2006.01) |
| ***F25B 1/00*** | (2006.01) |

AIR CONDITIONING SYSTEM

CROSS REFERENCE TO RELATED APPLICATION

This application is a U.S. national stage application of International Application PCT/JP2017/037166 filed on Oct. 13, 2017, the contents of which are incorporated herein by reference.

TECHNICAL FIELD

The present disclosure relates to an air conditioning system, and more particularly to an air conditioning system that includes a temperature adjustment apparatus configured to adjust the temperature of a liquid medium that exchanges heat with air in an indoor heat exchanger.

BACKGROUND

Conventionally, in an air conditioning control system that uses cold/hot water as a heating medium, the temperature at which the heating medium is supplied to a load apparatus is controlled constant (generally at 5 to 7° C.). In other words, even if the load of the load apparatus is increased or decreased, the temperature of the heating medium is not changed. When the load of the load apparatus is increased or decreased, the opening degree of a control valve disposed in the load apparatus is adjusted so as to increase or decrease the amount of the cold/hot water to be supplied to the load apparatus.

PATENT LITERATURE

PTL 1: Japanese Patent No. 5855279

In an air conditioning system which individually controls the performance of a load apparatus such as that described in Japanese Patent No. 5855279 (PTL 1), when the load of the load apparatus is increased or decreased, the opening degree of a control valve disposed in the load apparatus is adjusted so as to increase or decrease the amount of the cold/hot water to be supplied to the load apparatus. In this case, the ratio of the amount of latent heat treatment to the cooling capacity to be exhibited in lowering the temperature of a room to a target temperature increases. Therefore, the cooling capacity exhibited by the load apparatus becomes excessive, which increases the electric power to be consumed by the heat source apparatus disadvantageously. In addition, a humidity is lowered by unnecessary latent heat treatment, and such dryness in the room leads to discomfort of a user.

Further, in the case where the temperature of the heating medium is controlled constant, when the load of the load apparatus is low, the temperature of the heating medium becomes excessive than that required to cover the amount of heat actually consumed by the load apparatus, and thereby, the coefficient of performance (COP) of the heat source unit becomes low, which wastes energy.

SUMMARY

The present disclosure has been made to solve the problems above, and an object thereof to provide an air conditioning system that achieves improved energy saving effect and improved comfortness.

The present disclosure relates to an air conditioning system. The air conditioning system includes a heat source apparatus, a plurality of indoor heat exchangers, and a plurality of temperature adjustment apparatuses. The heat source apparatus is configured to heat or cool the liquid medium. Each of the plurality of indoor heat exchangers is supplied with the liquid medium from the heat source apparatus and configured to exchange heat between the liquid medium and air. Each of the plurality of temperature adjustment apparatuses is disposed in association with a respective one of the plurality of indoor heat exchangers and configured to adjust the temperature of the liquid medium supplied to a respective one of the plurality of indoor heat exchangers. Each of a plurality of temperature adjustment apparatuses is configured to variably adjust the amount of heat exchange between an inflow medium, which is a liquid medium supplied to a corresponding indoor heat exchanger, and an outflow medium, which is a liquid medium discharged from the corresponding indoor heat exchanger. Each of the plurality of temperature adjustment apparatuses is configured to reduce the heat exchanging capacity of the corresponding indoor heat exchanger by increasing the amount of heat exchange between the inflow medium and the outflow medium when the heat exchanging capacity of the corresponding indoor heat exchanger is larger than an indoor load. When in the plurality of temperature adjustment apparatuses, there is no temperature adjustment apparatus in which the amount of heat exchange between the inflow medium and the outflow medium is set to the minimum, the heat source apparatus is configured to reduce the heating capacity or the cooling capacity for changing the temperature of the liquid medium.

Since the air conditioning system of the present disclosure can finely adjust the temperature of the liquid medium supplied to the indoor heat exchanger and can keep the heat source apparatus to operate at a low capacity, it is possible for the air conditioning system to achieve improved temperature adjustment effect while maintaining energy saving effect.

DETAILED DESCRIPTION

Figure 1:
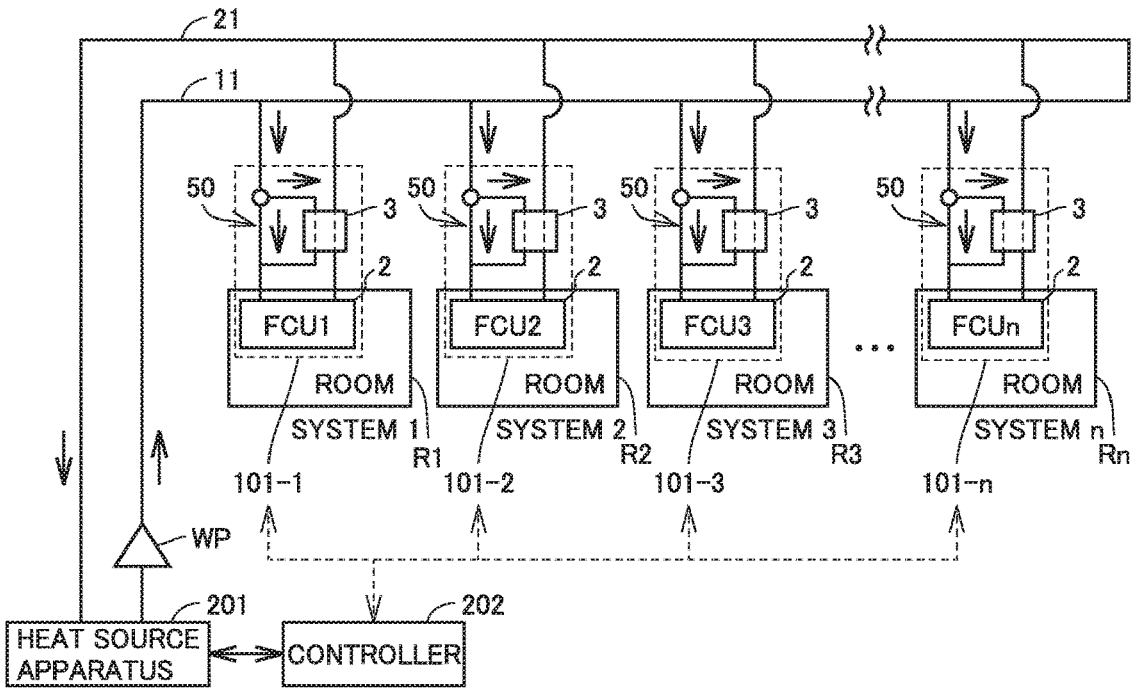
FIG. 1 is a diagram illustrating an overall configuration of an air conditioning system to which a temperature adjustment device of the present embodiment is applied.

Hereinafter, embodiments of the present invention will be described in detail with reference to the drawings. Although a plurality of embodiments will be described below, an appropriate combination of features described in each embodiment is originally intended. The same or corresponding portions in the drawings will be denoted by the same reference numerals.

First Embodiment

FIG. 1 is a diagram illustrating an overall configuration of an air conditioning system to which a temperature adjustment apparatus of the present embodiment is applied. With reference to FIG. 1, an air conditioning system 1000 includes a heat source apparatus 201, a controller 202, a pump WP, load apparatuses 101-1 to **101-*n*, a trunk pipe 11, and a trunk pipe 21. Although the controller 202 is illustrated as an independent device, it may be incorporated in the heat source apparatus 201**.

The heat source apparatus 201 is configured to cool or heat a heating medium to be supplied to the load apparatuses 101-1 to **101-*n*. The heating medium is supplied to the load apparatuses 101-1 to 101-1 from the heat source apparatus 201 through the trunk pipe 11 (supply path) and returned from the load apparatuses 101-1 to 101-*n* to the heat source apparatus 201 through the trunk pipe 21 (return path). The pump WP circulates the heating medium in the trunk pipe 11 and the trunk pipe 21 of the air conditioning system 1000**. The "heating medium" is not particularly limited, and it may be a liquid medium such as water.

The load apparatuses 101-1 to **101-*n* each includes a heat exchanger disposed in each of rooms R1 to Rn and configured to exchange heat between water and air in the room. The load apparatuses 101-1 to 101-*n* are connected in parallel between the trunk pipe 11 and the trunk pipe 21**.

The heating medium that is cooled by the heat source apparatus 201 during the cooling operation and heated by the heat source apparatus 201 during the heating operation is pumped by the pump WP into the load apparatuses 101-1 to **101-*n*. The heating medium pumped into the load apparatuses 101-1 to 101-*n* flows into the heat exchanger of the load apparatus and exchanges heat with air in the room, and thereby, the temperature of the heating medium rises in the cooling operation, and the temperature of the heating medium drops in the heating operation. Thereafter, the heating medium flows out of the heat exchanger in each of the load apparatuses 101-1 to 101-*n* and flows into the heat source apparatus 201** where it is cooled or heated again.

Figure 2:
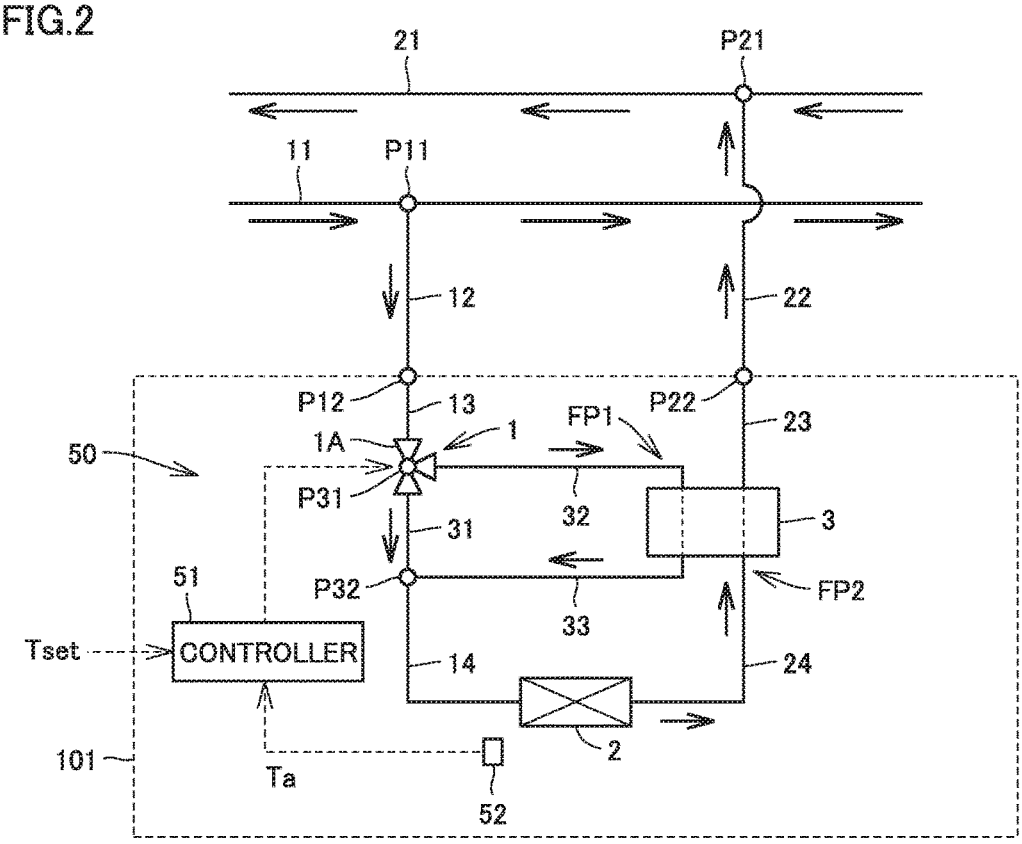
FIG. 2 is a diagram representatively illustrating a configuration of each load apparatus 101-1 to **101-*n* and a flow of a heating medium illustrated in FIG. 1**.

FIG. 2 is a view representatively illustrating a configuration of the load apparatuses 101-1 to **101-*n* and a flow of the heating medium illustrated in FIG. 1**.

With reference to FIGS. 1 and 2, the air conditioning system 1000 includes a heat source apparatus 201, a plurality of indoor heat exchangers 2, and a plurality of temperature adjustment apparatuses 50. The heat source apparatus 201 is configured to heat or cool the liquid medium. The plurality of indoor heat exchangers 2 each is supplied with the liquid medium from the heat source apparatus 201 and configured to exchange heat between the liquid medium and air. The indoor heat exchanger 2 includes a fan coil unit of FCU1 to FCUn as illustrated in FIG. 1.

Each of the plurality of temperature adjustment apparatuses 50 is disposed in association with a respective one of the plurality of indoor heat exchangers 2 and configured to adjust the temperature of the liquid medium to be supplied to a respective one of the plurality of indoor heat exchangers 2. Each of the plurality of temperature adjustment apparatuses 50 is configured to adjust the amount of heat exchange between an inflow medium, which is the liquid medium supplied to a corresponding indoor heat exchanger 2, and an outflow medium, which is the liquid medium discharged from the corresponding indoor heat exchanger in a variable range.

Each of the plurality of temperature adjustment apparatuses 50 reduces the heat exchanging capacity of a corresponding indoor heat exchanger 2 by increasing the amount of heat exchange between the inflow medium and the outflow medium when the heat exchanging capacity of the corresponding indoor heat exchanger 2 is larger than an indoor load.

With reference to FIG. 2, the load apparatus 101 includes the temperature adjustment apparatus 50 and the indoor heat exchanger 2. An end of a pipe 13 serves as a liquid inlet P12 of the load apparatus 101, and an end of a pipe 23 serves as a liquid outlet P22 of the load apparatus 101.

The load apparatus 101 is connected to the trunk pipes 11 and 21 at the liquid inlet P12 and the liquid outlet P22. The liquid inlet P12 is connected to a pipe 12 branched from a main branching point P11 in the trunk pipe 11 where the heating medium of the air conditioning system flows. The liquid outlet P22 is connected to a pipe 22 that is merged at a main merging point P21 with the trunk pipe 21 where the heating medium of the air conditioning system flows.

The temperature adjustment apparatus 50 adjusts the temperature of the liquid medium that exchanges heat with air in the indoor heat exchanger 2 connected to the heat source apparatus 201. The temperature adjustment apparatus 50 includes a pipe FP1 (first pipe) and a pipe FP2 (second pipe) where the liquid medium flows, a flow rate regulator 1, a controller 51, and a temperature sensor 52. The pipe FP1 is branched into a pipe 31 (first branch pipe) and pipes 32 and 33 (second branch pipe).

The liquid-liquid heat exchanger 3 is configured to exchange heat between the liquid medium that flows in the pipes 32 and 33 of the pipe FP1 and the liquid medium that flows in the pipe FP2. The flow rate regulator 1 is configured to adjust the flow rate of the liquid medium that flows in the pipes 32 and 33 and adjust the flow rate of the liquid medium that flows in the pipe 31. In the example illustrated in FIG. 2, the flow rate regulator 1 includes a flow rate distribution valve 1A which is disposed at a branching point P31 where the pipes 32 and 31 are branched and configured to adjust a ratio between the flow rate of the liquid medium that flows in the pipes 32 and 33 and the flow rate of the liquid medium that flows in the pipe 31. As the flow rate distribution valve 1A, for example, an electric three-way valve may be used. The flow rate distribution valve 1A may be disposed at a merging point P32 where the pipe 33 and the pipe 31 are merged, instead of being disposed at the branching point P31 where the pipe 32 and the pipe 31 are branched. Unlike a component such as a switching valve, the flow rate regulator 1 is configured to adjust stepwise or continuously the ratio between the flow rate of the liquid medium that flows in the pipes 32 and 33 and the flow rate of the liquid medium that flows in the pipe 31.

In the example illustrated in FIG. 2, the pipe FP1 constitutes a flow path for supplying the liquid medium from the heat source apparatus 201 to the indoor heat exchanger 2, and the pipe FP2 constitutes a flow path for returning the liquid medium from the indoor heat exchanger 2 to the heat source apparatus 201. The pipe FP1 includes pipes 31, 32 and 33. The pipe FP2 includes pipes 23 and 24.

The pipe 32 is branched from the pipe 13 which conveys the heating medium from the liquid inlet P12, and is configured to supply the heating medium to the first flow path in the liquid-liquid heat exchanger 3. The pipe 33 delivers the heating medium that flows out of the first flow path in the liquid-liquid heat exchanger 3 to a pipe 14. The pipe 31 constitutes a flow path that bypasses a heat exchange path in the liquid-liquid heat exchanger 3. The pipe 32 and the pipe 31 are branched at the branching point P31. The flow rate distribution valve 1A is disposed at the branching point P31. The pipe 31 and the pipe 33 are merged at the merging point P32.

The pipe 14 connects the merging point P32 and a liquid inlet of the indoor heat exchanger 2 to each other. The pipe 24 connects a liquid outlet of the indoor heat exchanger 2 and an inlet of the second flow path in the liquid-liquid heat exchanger 3 to each other. The second flow path is an intermediate flow path between the liquid outlet of the indoor heat exchanger 2 and the heat source apparatus 201. The pipe 23 connects an outlet of the second flow path in the liquid-liquid heat exchanger 3 and the liquid outlet P22 to each other.

The flow rate distribution valve 1A adjusts the ratio between the flow rates at which the heating medium flowing from the pipe 13 to the branching point P31 is distributed to flow in the pipe 31 and the pipe 32. FIGS. 3 to 6 each is a diagram illustrating a modification of the flow rate regulator. Although FIG. 2 illustrates a configuration in which the flow rate distribution valve 1A configured to adjust the distribution ratio is disposed at the branching point P31 as the flow rate regulator, it may be modified in the same manner as in the examples illustrated in FIGS. 3 to 6. For the sake of clarity in the drawings, the controller 51 and the temperature sensor 52 are not illustrated in FIG. 3 and the drawings that follow.

Figure 3:
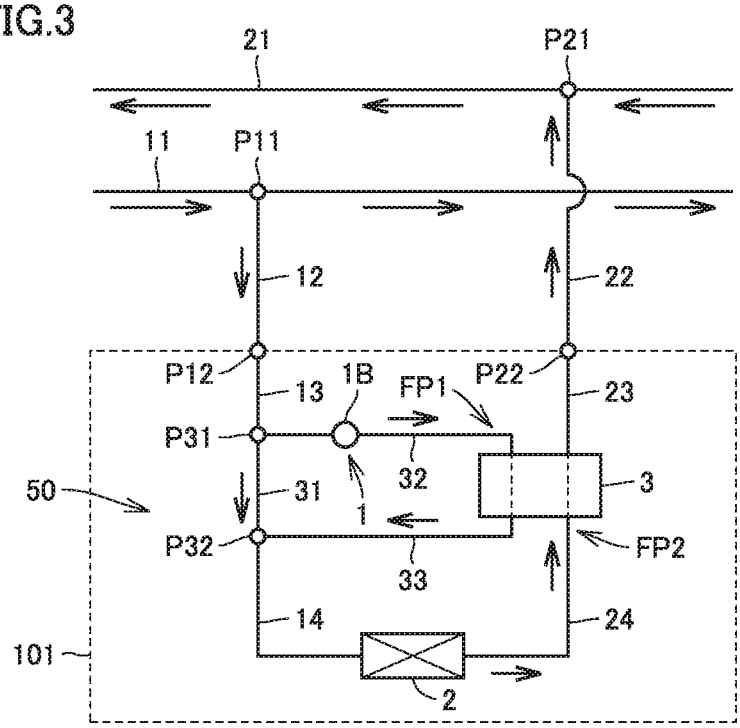
FIG. 3 is a diagram illustrating a first modification of a flow rate regulator.

In the example illustrated in FIG. 3, the flow rate regulator 1 includes a flow control valve 1B disposed in the pipe 32. Specifically, the flow control valve 1B is disposed in the pipe 32. The flow control valve 1B may be disposed in the pipe 33. The flow control valve 1B adjusts the ratio between the flow rate of the liquid medium that flows in the pipe 32 and the flow rate of the liquid medium that flows in the pipe 31. An electric valve whose opening degree is adjustable may be used as the flow control valve 1B. When the flow rate of the pipe 13 is constant, if the opening degree of the flow control valve 1B in the pipe 32 is reduced, the flow rate of the liquid medium that flows in the pipe 32 is decreased, and the flow rate of the liquid medium that flows in the pipe 31 is increased. In addition, the flow control valve 1B may be disposed in the pipe 31 instead of being disposed in the pipe 32.

Figure 4:
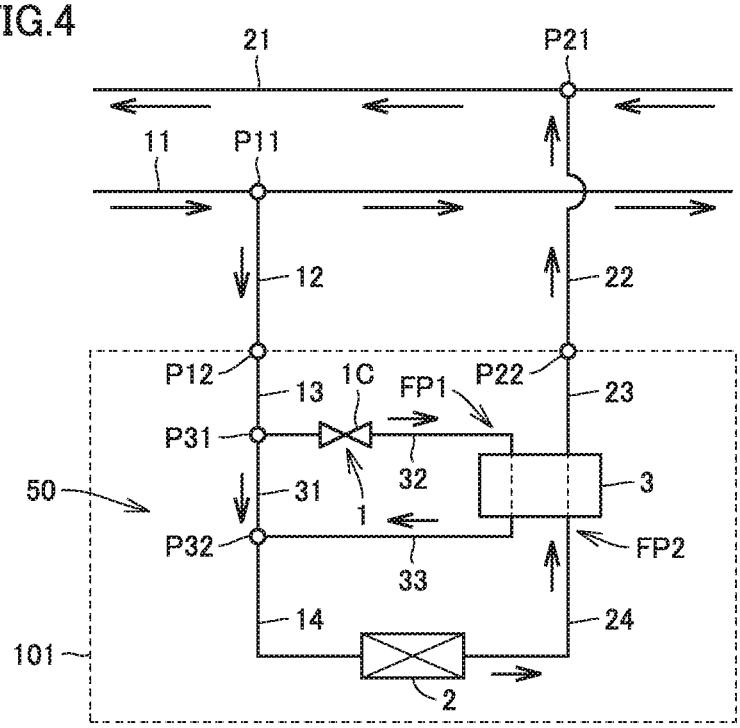
FIG. 4 is a view illustrating a second modification of the flow rate regulator.

In the example illustrated in FIG. 4, the flow rate regulator 1 includes a cutoff valve 1C which is disposed in the pipe 32 and configured to operate intermittently. Specifically, the cutoff valve 1C may operate intermittently, and is disposed in the pipe 32. The cutoff valve 1C may be disposed in the pipe 33. The cutoff valve 1C may be disposed in the pipe 31 instead of being disposed in the pipe 32. The controller 51 controls the opening and closing of the cutoff valve 1C so as to intermittently repeat ON/OFF. The controller 51 adjusts the ratio of the flow rate of the liquid medium that flows in the pipe 32 to the flow rate of the liquid medium that flows in the pipe 31 by adjusting the ON duty ratio of the cutoff valve 1C.

Figure 5:
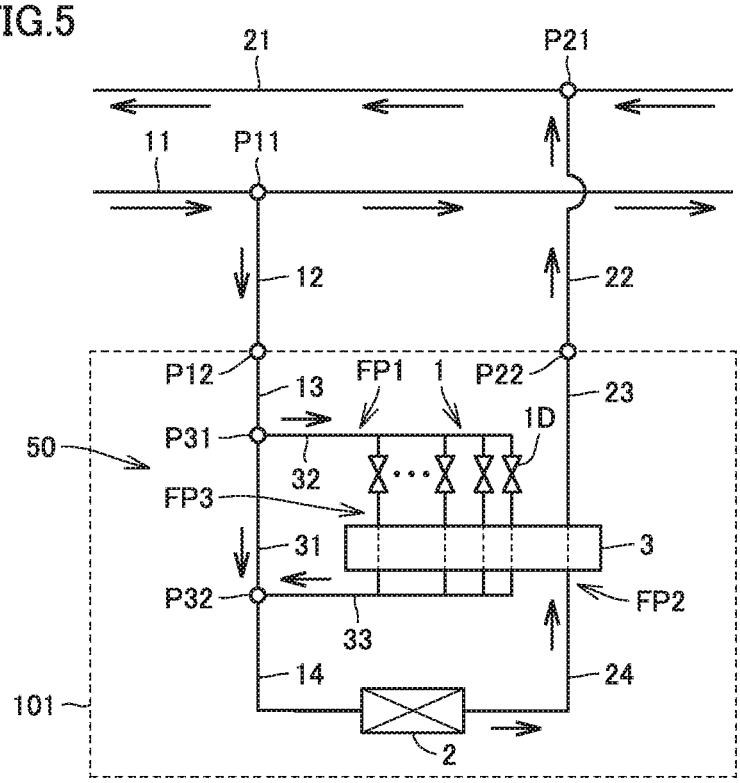
FIG. 5 is a view illustrating a third modification of the flow rate regulator.
Figure 6:
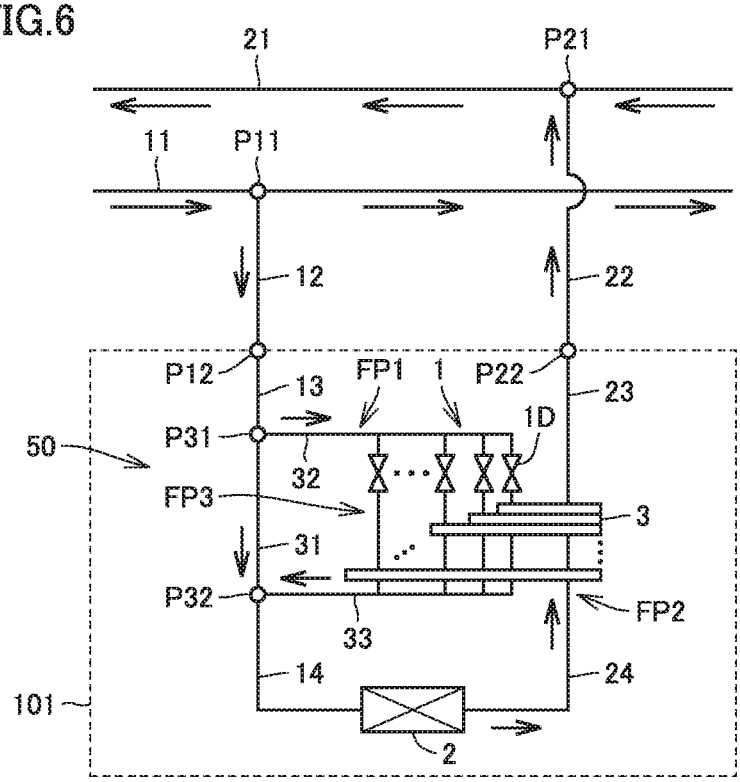
FIG. 6 is a view illustrating a fourth modification of the flow rate regulator.

In the example illustrated in FIGS. 5 and 6, the pipe FP1 includes a plurality of pipes (third branch pipes) FP3 connected in parallel to each other and configured to exchange heat with the liquid medium that flows in the pipe FP2. The flow rate regulator 1 includes a plurality of cutoff valves 1D, each of which is provided in a respective one of the plurality of pipes FP3.

Particularly in the example illustrated in FIG. 6, the liquid-liquid heat exchanger 3 is configured to differ the amount of heat exchange in each of the plurality of pipes FP3.

Although the flow rate regulator 1 illustrated in each of FIGS. 3 to 6 is disposed in the pipe 32, it may be disposed in the pipe 33.

The flow of the heating medium will be described again with reference to FIGS. 1 and 2. The arrows illustrated in FIG. 2 indicate the flow direction of the heating medium.

The heating medium pumped by the pump WP flows in the trunk pipe 11. A part of the heating medium that flows in the trunk pipe 11 flows into the load apparatus 101 from the liquid inlet P12 through the pipe 12 branched at the main branching point P11.

The heating medium flowing from the liquid inlet P12 flows through the pipe 13 and reaches the branching point P31. The heating medium (cold water) that has reached the branching point P31 is branched to flow in the pipe 31 and the pipe 32. The temperature of the heating medium that flows in the pipe 32 increases by exchanging heat in the liquid-liquid heat exchanger 3 with the heating medium on the downstream of the indoor heat exchanger 2. The heating medium whose temperature has increased flows through the pipe 33 and reaches the merging point P32. After the heating medium flows through the pipe 31 and reaches the merging point P32, it is mixed with the heating medium that flows in the pipe 33, and thereby, the temperature of the heating medium rises. The heating medium that has reached the merging point P32 flows through the pipe 14 into the indoor heat exchanger 2. The heating medium that has flowed into the indoor heat exchanger 2 exchanges heat with air to cool an indoor space. The heating medium rises in temperature due to the heat exchange with the air in the indoor heat exchanger 2, flows through the pipe 24 into the liquid-liquid heat exchanger 3. The heating medium that has flowed into the liquid-liquid heat exchanger 3 exchanges heat with the heating medium on the upstream, and thereby, the temperature thereof decreases. The heating medium whose temperature has decreased flows through the pipe 23 and reaches the liquid outlet P22.

The heating medium that has reached the liquid outlet P22 flows out of the load apparatus 101 into the pipe 22. The heating medium that flows in the pipe 22 is merged with the heating medium that flows in the trunk pipe 21 at the main merging point P21. The heating medium merged in the trunk pipe 21 flows into the heat source apparatus 201 in FIG. 1 where it is cooled again.

Figure 7:
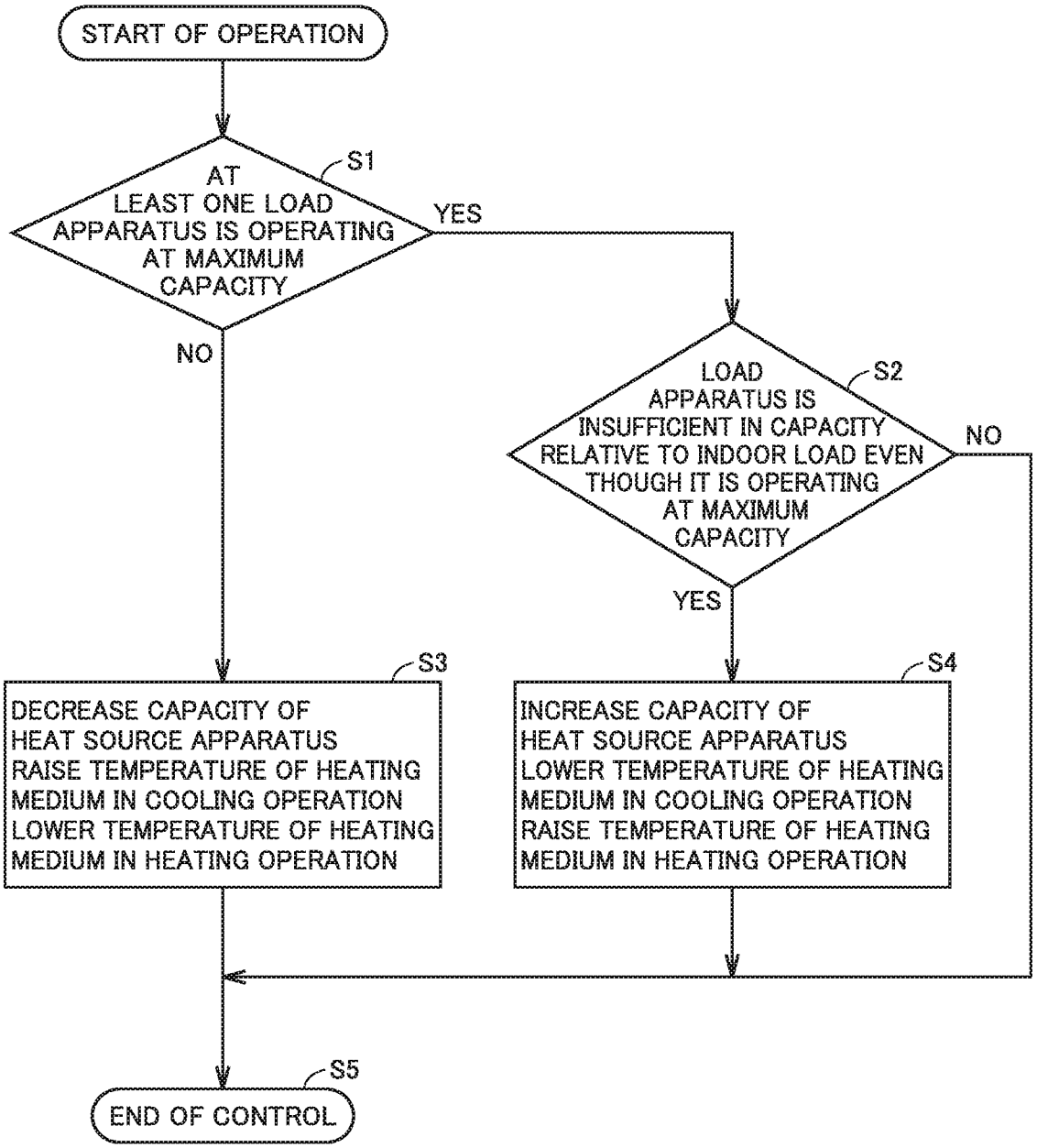
FIG. 7 is a flowchart illustrating operations of a heat source apparatus 201 in an air conditioning system according to a first embodiment.

FIG. 7 is a flowchart illustrating operations of the heat source apparatus 201 in the air conditioning system according to the first embodiment. Hereinafter, a temperature control of the heating medium in the heat source apparatus 201 according to the first embodiment will be described with reference to the flowchart illustrated in FIG. 7.

With reference to FIGS. 1 and 7, after the heat source apparatus 201 is actuated to operate, the controller 202 determines in step S1 whether or not each of the plurality of load apparatuses 101-1 to **101-*n*** is operating at the maximum capacity.

First, how the controller 202 determines whether or not the load apparatus 101 is operating at the maximum capacity in step S1 will be described. The load apparatus 101 illustrated in FIG. 2 is operating at the maximum capacity when the heating medium that has flowed into the load apparatus 101 flows into the indoor heat exchanger 2 with substantially the same temperature as that when the heating medium is heated or cooled in the heat source apparatus 201. Therefore, a temperature sensor is disposed in the pipe 14 on the upstream of the indoor heat exchanger 2, and the measured temperature is compared with the temperature of the heating medium in the heat source apparatus 201. If the two temperatures are equal to each other, it is determined that the capacity is the maximum.

Alternatively, the determination may be made in accordance with the flow rate of the heating medium in the pipe 32. When the controller 51 controls the flow rate distribution valve 1A so that the ratio of the heating medium distributed to the primary side passage of the liquid-liquid heat exchanger 3 is 0%, all the heating medium (cold water) from the heat source apparatus 201 flows through the pipe 31 into the indoor heat exchanger 2. In this case, the cooling capacity of the indoor heat exchanger 2 is set to the maximum.

When no heating medium flows in the pipe 32, all the heating medium flows into the indoor heat exchanger 2 without exchanging heat in the liquid-liquid heat exchanger 3. In this case, the temperature of the heating medium that has flowed into the indoor heat exchanger 2 is equal to the temperature of the heating medium when it flows into the load apparatus 101. Thus, when the flow rate distribution valve 1A disposed at the branching point P31 is controlled to prevent the heating medium from flowing into the pipe 32, it may be determined that the load apparatus 101 is operating at the maximum capacity. In other words, when the controller 51 controls the flow rate distribution valve 1A such that the ratio of the heating medium distributed to the primary side passage of the liquid-liquid heat exchanger 3 is 0%, it may be determined that the load apparatus 101 is operating at the maximum capacity.

If none of the load apparatuses 101-1 to **101-*n* is operating at the maximum capacity (NO in step S1), the controller 202 reduces the capacity of the heat source apparatus 201 in step S3**.

If none of the load apparatuses 101-1 to **101-*n* is operating at the maximum capacity when the air conditioning system 1000 is performing the cooling operation, the controller 202 instructs the heat source apparatus 201 to raise the cooling temperature of the heating medium. Thereby, the capacity of the heat source apparatus 201 is reduced. When the cooling temperature of the heating medium is raised, the refrigerant evaporation temperature of the heat source apparatus 201** rises, which makes it possible to improve the coefficient of performance (COP) and obtain energy saving effect.

On the other hand, if none of the load apparatuses 101-1 to **101-*n* is operating at the maximum capacity when the air conditioning system 1000 is performing the heating operation, the controller 202 instructs the heat source apparatus 201 to lower the cooling temperature of the heating medium. Thereby, the capacity of the heat source apparatus 201 is reduced. When the heating temperature of the heating medium is lowered, the condensation temperature of the heat source apparatus 201** is low, which makes it possible to improve the COP and obtain energy saving effect.

In step S1, if it is determined that at least one of the load apparatuses 101-1 to **101-*n* is operating at the maximum capacity (YES in step S1), the controller 202 determines in step S2** whether or not the load apparatus is insufficient in capacity relative to the air conditioning load even though it is operating at the maximum capacity.

First, how the controller 202 determines whether or not the load apparatus 101 is excessive or insufficient in capacity in step S2 will be described. The load apparatus 101 operates so as to achieve a target temperature Tset set by the user using a remote controller or the like. When the difference between the target temperature Tset and an indoor temperature Ta measured by the temperature sensor 52 is equal to or less than a predetermined value, and the indoor temperature is lower than the target temperature in the cooling operation and higher than the target temperature in the heating operation (the indoor load is larger than the capacity of the load apparatus), it may be determined that the capacity is excessive. On the contrary, when the difference between the target temperature Tset and the indoor temperature Ta is greater than the predetermined value, and the indoor temperature is higher than the target temperature in the cooling operation and lower than the target temperature in the heating operation (the indoor load is smaller than the capacity of the load apparatus), it may be determined that the capacity is insufficient.

If a load apparatus is insufficient in capacity even though it is operating at the maximum capacity (YES in step S2), the controller 202 increases the capacity of the heat source apparatus 201.

If a load apparatus is insufficient in capacity even though it is operating at the maximum capacity when the air conditioning system 1000 is performing the cooling operation, the controller 202 instructs the heat source apparatus 201 to lower the cooling temperature of the heating medium. As a result, the capacity of the heat source apparatus 201 is increased, and the control is ended (S5).

On the other hand, if a load apparatus is insufficient in capacity even though it is operating at the maximum capacity when the air conditioning system 1000 is performing the heating operation, the controller 202 instructs the heat source apparatus 201 to raise the heating temperature of the heating medium. As a result, the capacity of the heat source apparatus 201 is increased, and the control is ended (S5).

If it is determined that no load apparatus is insufficient in capacity when operating at the maximum capacity in step S2 (NO in step S2), the controller 202 ends the control without instructing the heat source apparatus 201 to change the operating state (S5).

Figure 8:
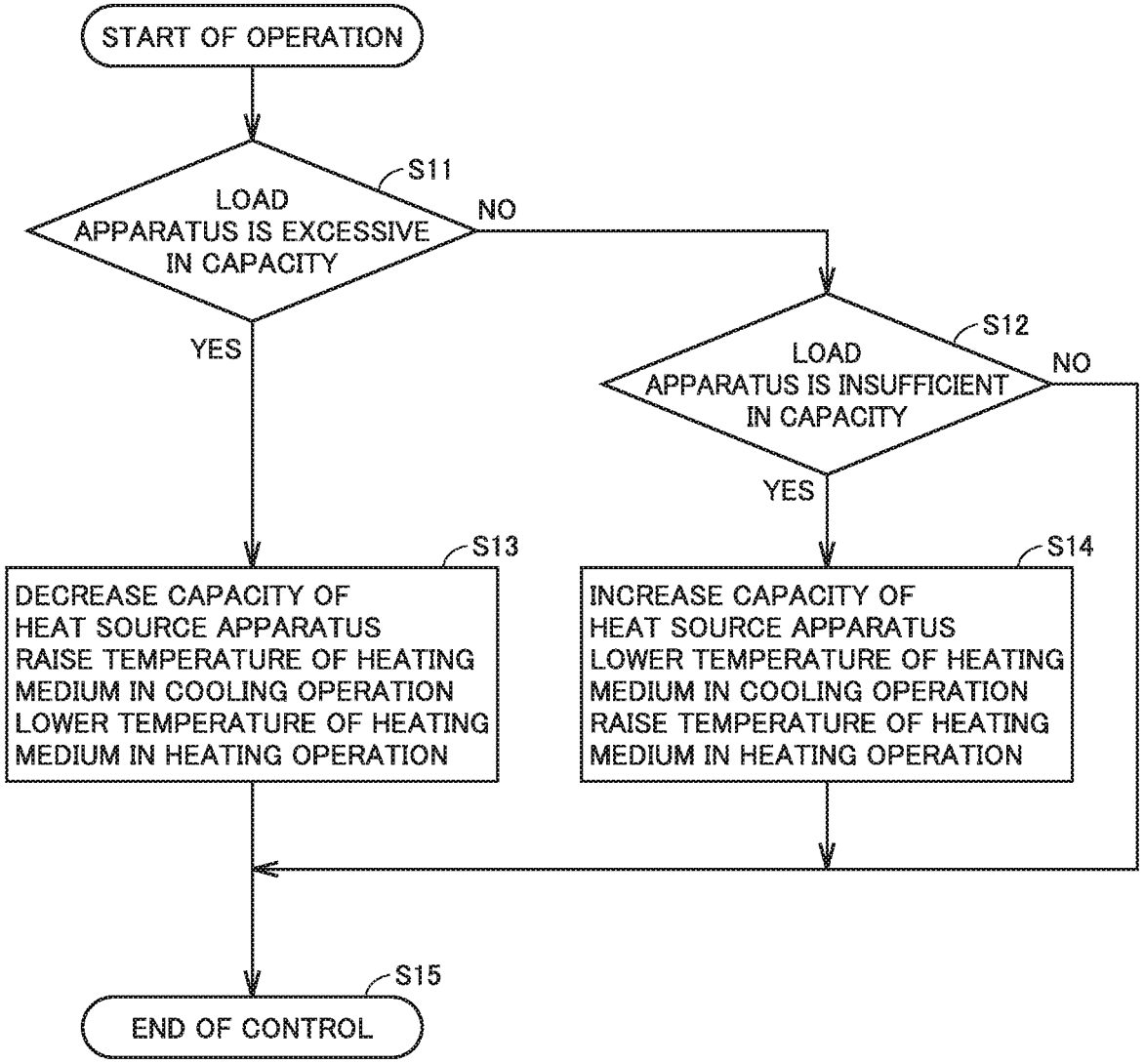
FIG. 8 is a flowchart illustrating operations of a load apparatus 101 in the air conditioning system according to the first embodiment.

FIG. 8 is a flowchart illustrating operations of the load apparatus 101 in the air conditioning system according to the first embodiment. Hereinafter, the temperature control of the heating medium in the heat source apparatus 201 according to the first embodiment will be described with reference to the flowchart illustrated in FIG. 8.

With reference to FIGS. 1 and 8, after any of load apparatuses 101-1 to **101-*n* is actuated to operate, the controller 202 determines in step S11 whether or not the load apparatus 101 is excessive in capacity. Whether or not the load apparatus 101 is excessive in capacity may be determined in step S11 in the same manner as in step S2**.

If the load apparatus 101 after the actuation is excessive in capacity (YES in step S11), the controller 202 changes the amount of heat exchange of the temperature adjustment apparatus to reduce the capacity of the load apparatus 101.

Thus, if the controller 202 determines that the capacity of the load apparatus 101 is larger than the indoor load when the air conditioning system 1000 is performing the cooling operation, the controller 202 instructs the load apparatus 101 to raise the temperature of the heating medium flowing into the indoor heat exchanger 2. As a result, the capacity of the load apparatus 101 is reduced. In order to raise the temperature of the heating medium flowing into the indoor heat exchanger 2, the flow rate distribution valve 1A of the load apparatus 101 is controlled to adjust the distribution ratio so as to increase the flow rate of the heating medium flowing into the liquid-liquid heat exchanger 3, which thereby increases the amount of heat exchange.

On the other hand, if the controller 202 determines that the capacity of the load apparatus 101 is larger than the indoor load when the air conditioning system 1000 is performing the heating operation, the controller 202 instructs the load apparatus 101 to lower the temperature of the heating medium flowing into the indoor heat exchanger 2. As a result, the capacity of the load apparatus 101 is increased. In order to lower the temperature of the heating medium flowing into the indoor heat exchanger 2, the flow rate distribution valve 1A of the load apparatus 101 is controlled to adjust the distribution ratio so as to decrease the flow rate of the heating medium flowing into the liquid-liquid heat exchanger 3, which thereby decreases the amount of heat exchange.

If the controller 202 determines in step S11 that the capacity of the load apparatus 101 is not excessive (NO in step S11), the controller 202 determines in step S12 whether or not the load apparatus 101 is insufficient in capacity.

Whether or not the load apparatus 101 is insufficient in capacity may be determined in step S12 in the same manner as in step S2.

If the load apparatus 101 is insufficient in capacity (YES in step S12), the controller 202 increases the capacity of the load apparatus 101.

Thus, if the controller 202 determines that the capacity of the load apparatus 101 is smaller than the indoor load (YES in step S12) when the air conditioning system 1000 is performing the cooling operation, the controller 202 instructs the load apparatus 101 to lower the temperature of the heating medium flowing into the indoor heat exchanger 2. As a result, the capacity of the load apparatus 101 is increased (S14). In order to lower the temperature of the heating medium flowing into the indoor heat exchanger 2, the flow rate distribution valve 1A of the load apparatus 101 is controlled to adjust the distribution ratio so as to decrease the flow rate of the heating medium flowing into the liquid-liquid heat exchanger 3, and the control is ended (S15).

On the other hand, if the controller 202 determines that the capacity of the load apparatus 101 is smaller than the indoor load (YES in step S12) when the air conditioning system 1000 is performing the heating operation, the controller 202 instructs the load apparatus 101 to raise the temperature of the heating medium flowing into the indoor heat exchanger 2. As a result, the capacity of the load apparatus 101 is increased (S14). In order to raise the temperature of the heating medium flowing into the indoor heat exchanger 2, the flow rate distribution valve 1A of the load apparatus 101 is controlled to adjust the distribution ratio so as to increase the flow rate of the heating medium flowing into the liquid-liquid heat exchanger 3, and the control is ended (S15).

If the controller 202 determines in step S12 that the capacity of the load apparatus 101 is not insufficient (NO in step S12), the controller 202 ends the control without instructing the load apparatus 101 to change the capacity (S15).

According to the air conditioning system of the present embodiment, by adjusting the air conditioning capacity using the temperature of the cold/hot water flowing into the load apparatus, the load apparatus does not exhibit excessive cooling capacity to reach the target temperature. Therefore, it is possible to reduce the electric power consumed by the heat source apparatus. Further, when all the load apparatuses are controlled to operate at a lower capacity, by prioritizing the temperature control of water in the heat source apparatus, it is possible to improve the COP of the heat source apparatus and obtain the energy saving effect.

In the following embodiments, the configuration of a load apparatus that replaces the load apparatus 101 in the first embodiment will be described.

Second Embodiment

Figure 9:
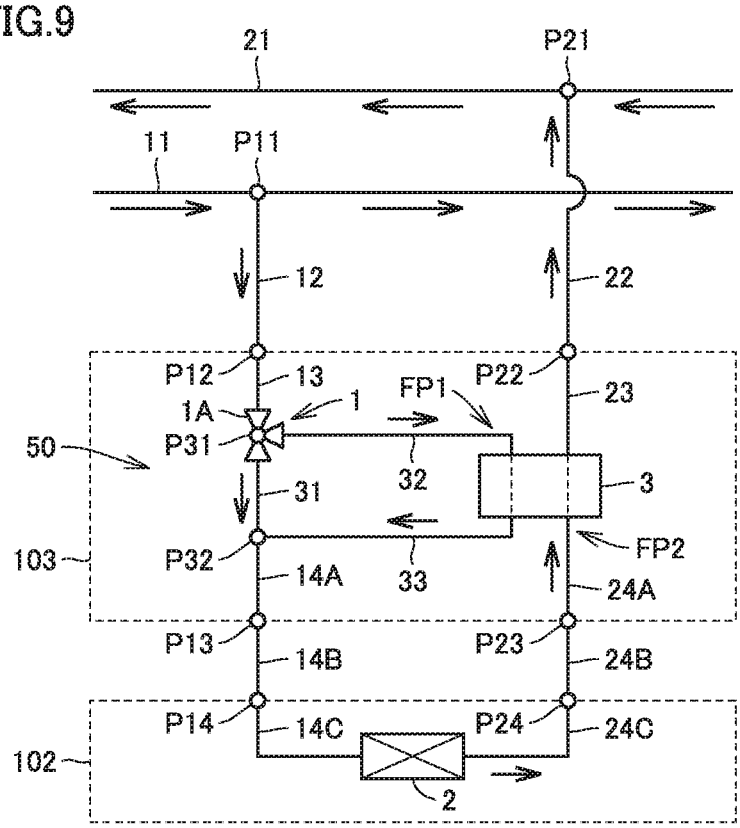
FIG. 9 is a diagram illustrating a flow path of a load apparatus 102 and an intermediary apparatus 103 and a flow of a heating medium according to a second embodiment.

FIG. 9 is a diagram illustrating a flow path of a load apparatus 102 and an intermediary apparatus 103 and a flow of a heating medium according to a second embodiment.

In the second embodiment, the components included in the load apparatus 101 according to the first embodiment are grouped and accommodated in two apparatuses: the load apparatus 102 and the intermediary apparatus 103.

The heating medium flows into the load apparatus 102 from a liquid inlet P14 and flows out of the load apparatus 102 from a liquid outlet P24. The load apparatus 102 includes an indoor heat exchanger 2, a pipe 14C that connects the liquid inlet P14 and the indoor heat exchanger 2 to each other, and a pipe 24C that connects the indoor heat exchanger 2 and the liquid outlet P24 to each other.

The intermediary apparatus 103 includes a liquid-liquid heat exchanger 3 and a temperature adjustment apparatus 50. The intermediary apparatus 103 is disposed between the trunk pipes 11 and 21 for conveying the liquid medium and the indoor heat exchanger 2. Note that instead of the temperature adjustment apparatus 50, the intermediary apparatus 103 may include any of the temperature adjustment apparatuses such as those illustrated in FIGS. 3 to 6 and a temperature adjustment apparatus illustrated in FIG. 13.

The intermediary apparatus 103 further includes a first path from a liquid inlet P12 to a liquid outlet P13 and a second path from a liquid inlet P23 to a liquid outlet P22. The first path includes a pipe 13 that connect the liquid inlet P12 and the branching point P31 to each other, a pipe 31 that connects the branching point P31 and the merging point P32 to each other, a pipe 32 that connects the branching point P31 and the liquid-liquid heat exchanger 3 to each other, a pipe 33 that connects the liquid-liquid heat exchanger 3 and the merging point P32 to each other, and a pipe 14A that connects the merging point P32 and the liquid outlet P13 to each other.

The second path includes a pipe 24A that connects the liquid inlet P23 and the liquid-liquid heat exchanger 3 to each other and a pipe 23 that connects the liquid-liquid heat exchanger 3 and the liquid outlet P22 to each other.

The intermediary apparatus 103 includes a flow rate distribution valve 1A that adjusts the flow rate at which the heating medium flowing from the pipe 13 to the branching point P31 is branched to flow in the pipe 31 and the pipe 32. Although FIG. 9 illustrates a configuration in which the flow rate regulator 1 includes the flow rate distribution valve 1A disposed at the branching point P31, it may be modified in the same manner as in the examples illustrated in FIGS. 3 to 6. Although the flow rate regulator 1 is disposed in the pipe 32 as illustrated in FIGS. 3 to 6 and 9, it may be disposed in the pipe 33.

The intermediary apparatus 103 is connected to the heat source apparatus at two locations: the liquid inlet P12 and the liquid outlet P22. The liquid inlet P12 is connected to the pipe 12 that is branched at the main branching point P11 from the trunk pipe 11 through which the heating medium of the air conditioning system flows. The liquid outlet P22 is connected to the pipe 22 that is merged at the main merging point P21 with the trunk pipe 21 through which the heating medium of the air conditioning system flows.

The load apparatus 102 is connected to the intermediary apparatus 103 at two locations: the liquid inlet P14 and the liquid outlet P24. The liquid inlet P14 is connected to the liquid outlet P13 of the intermediary apparatus 103 by a pipe 14B. The liquid outlet P24 is connected to the liquid inlet P23 of the intermediary apparatus 103 by a pipe 24B.

The flow of the heating medium will be described with reference to FIG. 9. The arrows illustrated in FIG. 9 indicate the flow direction of the heating medium. The heating medium pumped by the pump WP of FIG. 1 flows in the trunk pipe 11. A part of the heating medium that flows in the trunk pipe 11 flows into the intermediary apparatus 103 from the liquid inlet P12 through the pipe 12 branched at the main branching point P11.

The heating medium flowing from the liquid inlet P12 flows through the pipe 13 and reaches the branching point P31. The heating medium (cold water) that has reached the branching point P31 is branched to flow in the pipe 31 and the pipe 32. The temperature of the heating medium that flows in the pipe 32 increases by exchanging heat with the heating medium on the downstream of the indoor heat exchanger 2 in the liquid-liquid heat exchanger 3. The heating medium whose temperature has increased flows through the pipe 33 and reaches the merging point P32. After the heating medium flows through the pipe 31 and reaches the merging point P32, it is mixed with the heating medium that flows in the pipe 33, and thereby, the temperature of the heating medium rises. The heating medium that has reached the merging point P32 flows through the pipe 14A and reaches the liquid outlet P13. The heating medium that has reached the liquid outlet P13 flows out of the intermediary apparatus 103 into the pipe 14B. The heating medium that flows in the pipe 14B flows into the load apparatus 102 from the liquid inlet P14.

The heating medium that has flowed into the load apparatus 102 flows through the pipe 14C into the indoor heat exchanger 2. The heating medium that has flowed into the indoor heat exchanger 2 exchanges heat with air to cool an indoor space. The heating medium rises in temperature due to the heat exchange with the air in the indoor heat exchanger 2, flows through the pipe 24C and reaches the liquid outlet P24. The heating medium that has reached the liquid outlet P24 flows out of the load apparatus 102 and flows into the pipe 24B. The heating medium flows through the pipe 24B and reaches the liquid inlet P23 of the intermediary apparatus 103. The heating medium that has reached the liquid inlet P23 flows through the pipe 24A into the liquid-liquid heat exchanger 3. The heating medium that has flowed into the liquid-liquid heat exchanger 3 exchanges heat with the heating medium on the upstream, and thereby, the temperature thereof decreases. The heating medium whose temperature has decreased flows through the pipe 23 and reaches the liquid outlet P22.

The heating medium that has reached the liquid outlet P22 flows out of the intermediary apparatus 103 into the pipe 22. The heating medium that flows in the pipe 22 is merged with the heating medium that flows in the trunk pipe 21 at the main merging point P21. The heating medium merged in the trunk pipe 21 flows into the heat source apparatus 201 in FIG. 1 where it is cooled again.

The configuration of the second embodiment illustrated in FIG. 9 is the same as that of a general air conditioning system when the intermediary apparatus 103 is removed. In other words, the configuration of the second embodiment is obtained by connecting the intermediary apparatus 103 between the pipe 12 and the liquid inlet P14 and between the pipe 22 and the liquid outlet P24 in a general air conditioning system. Thus, in a building in which an air conditioning system has already been introduced, by detaching the liquid inlet P14 from the pipe 12 and the liquid outlet P24 from the pipe 22 and then introducing the intermediary apparatus 103, it is possible to readily improve the energy saving effect of an existing air conditioning system.

Figure 10:
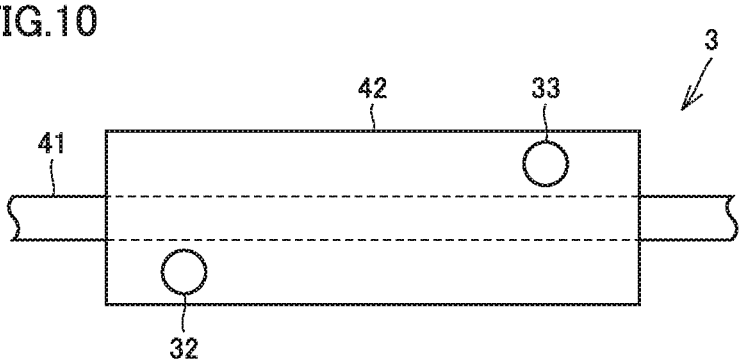
FIG. 10 is a front view illustrating an example configuration of a liquid-liquid heat exchanger 3.
Figure 11:
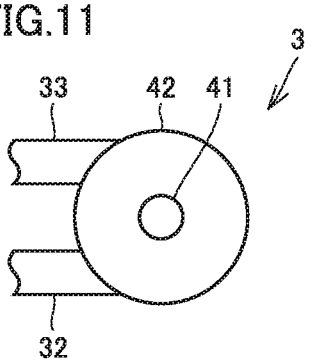
FIG. 11 is a side view illustrating an example configuration of the liquid-liquid heat exchanger 3.
Figure 12:
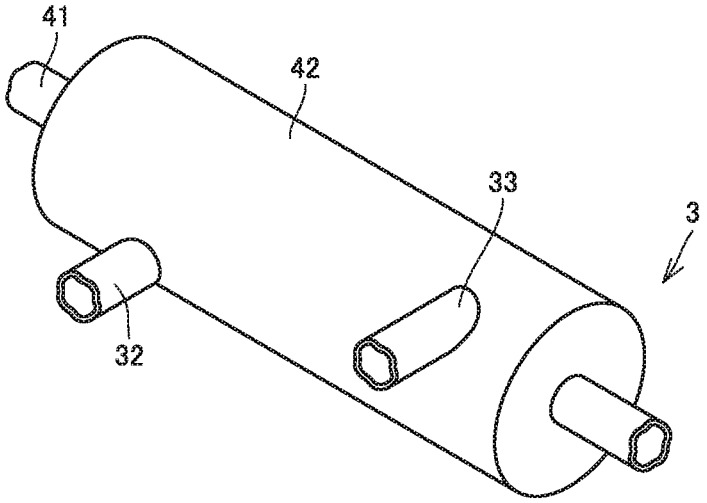
FIG. 12 is a perspective view illustrating an example configuration of the liquid-liquid heat exchanger 3.

An exemplary configuration of the liquid-liquid heat exchanger 3 preferred for readily introducing a function of adjusting a temperature of the heating medium into an existing air conditioning system will be described. FIG. 10 is a front view illustrating the example configuration of the liquid-liquid heat exchanger 3. FIG. 11 is a side view illustrating the example configuration of the liquid-liquid heat exchanger 3. FIG. 12 is a perspective view illustrating the example configuration of the liquid-liquid heat exchanger 3.

In FIGS. 10 to 12, one of the components in the liquid-liquid heat exchanger 3 is an existing pipe 41. As illustrated in FIGS. 10 to 12, a cylindrical component 42 having an inner diameter larger in diameter than the existing pipe 41 is provided to cover the existing pipe 41 around the same. A pipe connection portion is provided in a side surface of the component 42, to which the pipes 32 and 33 in FIG. 9 can be connected. By dividing the cylindrical component 42, arranging the divided components to cover the pipe 41 around the same, and thereafter integrating the components together, the inside and the outside of the existing pipe are filled with the heating medium and heat can be exchanged. Since one of the heat exchangers can be used with its existing state being maintained, it is easier to be introduced into an existing air conditioning system.

Third Embodiment

Figure 13:
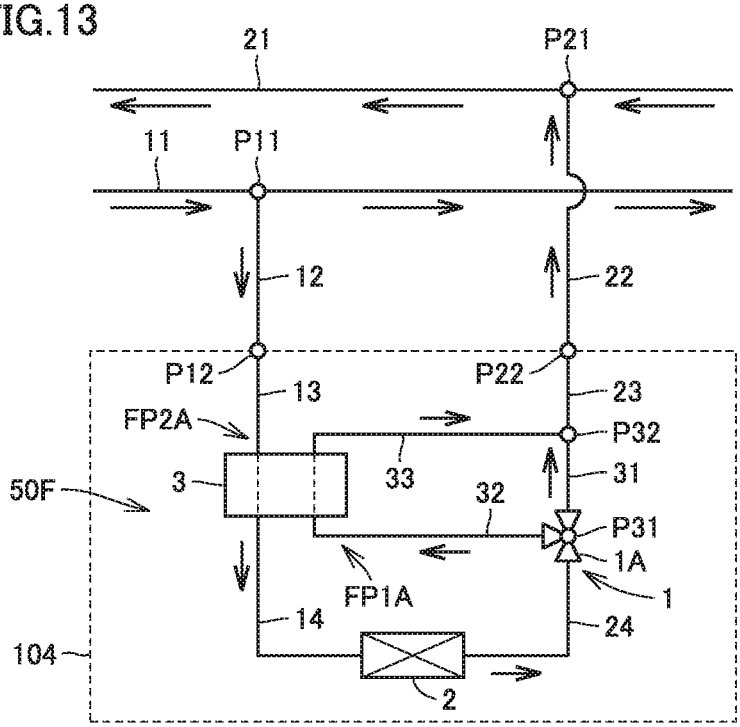
FIG. 13 is a diagram illustrating a flow path of a load apparatus and a flow of a heating medium according to a third embodiment.

FIG. 13 is a diagram illustrating a flow path of a load apparatus and a flow of a heating medium according to a third embodiment. With reference to FIG. 13, a load apparatus 104 includes a temperature adjustment apparatus 50F and an indoor heat exchanger 2. The temperature adjustment apparatus 50F includes pipes FP1A and FP2A through which the liquid medium flows, a liquid-liquid heat exchanger 3, a pipe 31 branched from the pipe FP1A and bypassing the liquid-liquid heat exchanger 3, and a flow rate regulator 1. The flow rate regulator 1 includes a flow rate distribution valve 1A. The pipe FP1A includes pipes 32 and 33. The pipe FP2A includes pipes 13 and 14. Although not illustrated in the drawings, a controller 51 and a temperature sensor 52 may be disposed in the same manner as in FIG. 2.

The pipe 13 guides the heating medium from the liquid inlet P12 to the liquid-liquid heat exchanger 3. The pipe 14 connects the liquid-liquid heat exchanger 3 and the indoor heat exchanger 2 to each other. The pipe 24 connects the indoor heat exchanger 2 and the branching point P31 to each other. The pipe 31 serves as a main passage that connects the branching point P31 and the merging point P32 to each other. The pipe 32 connects the branching point P31 and the liquid-liquid heat exchanger 3 to each other. The pipe 33 connects the liquid-liquid heat exchanger 3 and the merging point P32 to each other. The pipe 23 connects the merging point P32 and the liquid outlet P22 to each other.

The load apparatus 104 includes a flow rate distribution valve 1A that adjusts the flow rate at which the heating medium flowing from the pipe 24 into the branching point P31 is distributed to flow in the pipe 31 and the pipe 32. Although FIG. 13 illustrates a configuration in which the flow rate distribution valve 1A is disposed at the branching point P31, it may be modified in the same manner as in the examples illustrated in FIGS. 3 to 6. Although the flow rate regulator is disposed in the pipe 32 as illustrated in FIGS. 3 to 6, it may be disposed in the pipe 33.

The load apparatus 104 is connected to the trunk pipes 11 and 21 extending from the heat source apparatus at two locations: the liquid inlet P12 and the liquid outlet P22, respectively. The liquid inlet P12 is connected to the pipe 12 branched from the main branching point P11 of the trunk pipe 11 through which the heating medium of the air conditioning system flows. The liquid outlet P22 is connected to the pipe 22 merged at the main merging point P21 with the trunk pipe 21 through which the heating medium of the air conditioning system flows.

The flow of the heating medium will be described with reference to FIG. 13. The arrows illustrated in FIG. 13 indicate the flow direction of the heating medium. The heating medium pumped by the pump WP of FIG. 1 flows in the trunk pipe 11. A part of the heating medium that flows in the trunk pipe 11 flows into the load apparatus 104 from the liquid inlet P12 through the pipe 12 branched at the main branching point P11.

The heating medium (cold water) flowing from the liquid inlet P12 flows through the pipe 13 into the liquid-liquid heat exchanger 3, and exchanges heat with the heating medium on the downstream of the indoor heat exchanger 2, and thereby, the temperature thereof is increased. The heating medium whose temperature has increased flows through the pipe 14 into the indoor heat exchanger 2. The heating medium that has flowed into the indoor heat exchanger 2 exchanges heat with air to cool an indoor space. The heating medium that has exchanged heat with air in the indoor heat exchanger 2 increases in temperature and reaches the branching point P31. The heating medium that has reached the branching point P31 is branched to flow in the pipes 31 and 32. The heating medium that flows in the pipe 32 exchanges heat in the liquid-liquid heat exchanger 3 with the heating medium on the upstream, and thereby the temperature thereof is decreased. The heating medium whose temperature has decreased flows through the pipe 33 and reaches the merging point P32. After the heating medium flows through the pipe 31 and reaches the merging point P32, it is mixed with the heating medium that flows in the pipe 33, and thereby, the temperature thereof is decreased. The heating medium that has reached the merging point P32 flows through the pipe 23 and reaches the liquid outlet P22.

The heating medium that has reached the liquid outlet P22 flows out of the load apparatus 104 into the pipe 22. The heating medium that flows in the pipe 22 is merged with the heating medium that flows in the trunk pipe 21 at the main merging point P21. The heating medium merged in the trunk pipe 21 flows into the heat source apparatus 201 in FIG. 1 where it is cooled again.

As described above, by providing a flow path that bypasses the liquid-liquid heat exchanger 3 on the downstream of the indoor heat exchanger 2 as in the third embodiment, it is also possible to adjust the temperature of the heating medium supplied to the indoor heat exchanger 2 as in the configuration in FIG. 2.

Fourth Embodiment

Figure 14:
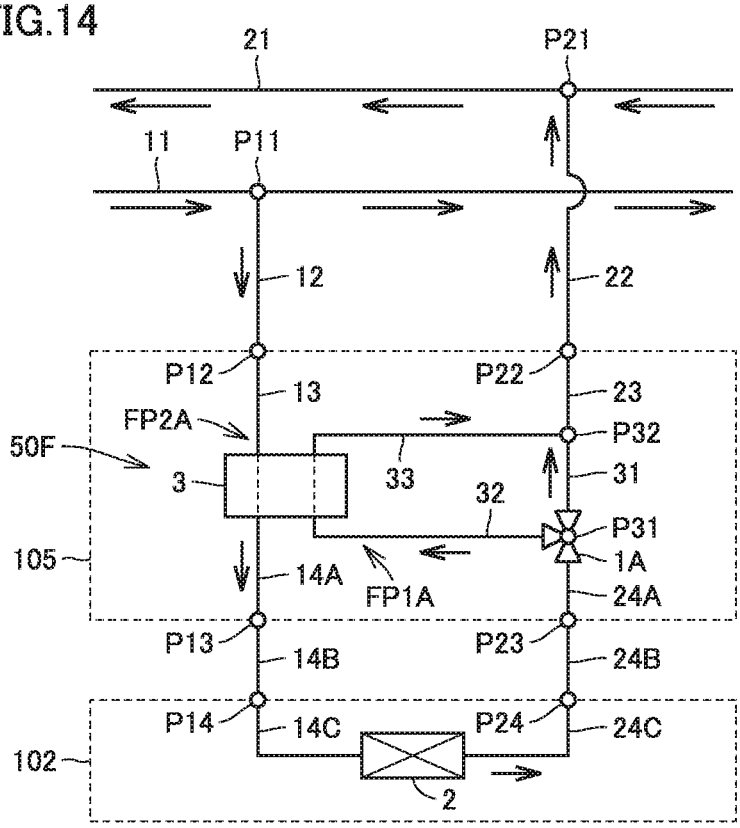
FIG. 14 is a diagram illustrating a flow path of a load apparatus 102 and an intermediary apparatus 105 and a flow of a heating medium according to a fourth embodiment.

FIG. 14 is a diagram illustrating a flow path of a load apparatus 102 and an intermediary apparatus 105 and a flow of a heating medium according to a fourth embodiment.

In the fourth embodiment, the components included in the load apparatus 104 according to the third embodiment are grouped and accommodated in two apparatuses: the load apparatus 102 and the intermediary apparatus 105. Since the configuration of the load apparatus 102 is the same as that in the second and third embodiments, the description thereof will not be repeated.

The intermediary apparatus 105 includes a liquid-liquid heat exchanger 3 and a temperature adjustment apparatus 50. The intermediary apparatus 105 is disposed between the trunk pipes 11 and 21 for conveying the liquid medium and the indoor heat exchanger 2.

The intermediary apparatus 105 further includes a first path from a liquid inlet P12 to a liquid outlet P13 and a second path from a liquid inlet P23 to a liquid outlet P22. The first path includes a pipe 13 that connects the liquid inlet P12 and the liquid-liquid heat exchanger 3 to each other, and a pipe 14A that connects the liquid-liquid heat exchanger 3 and the liquid outlet P13 to each other. The second path includes a pipe 24A that connects the liquid inlet P23 and the branching point P31 to each other, a pipe 31 that connects the branching point P31 and the merging point P32 to each other, a pipe 32 that connects the branching point P31 and the liquid-liquid heat exchanger 3 to each other, a pipe 33 that connects the liquid-liquid heat exchanger 3 and the merging point P32 to each other, and a pipe 23 that connects the merging point P32 and the liquid outlet P22 to each other.

The intermediary apparatus 105 includes a flow rate distribution valve 1A that adjusts a flow rate at which the heating medium flowing from the pipe 24A to the branching point P31 is branched to flow in the pipe 31 and the pipe 32. Although FIG. 14 illustrates a configuration in which the flow rate distribution valve 1A is disposed at the branching point P31, it may be modified in the same manner as in the examples illustrated in FIGS. 3 to 6. Although the flow rate regulator 1 is disposed in the pipe 32 as illustrated in FIGS. 3 to 6, it may be disposed in the pipe 33.

The intermediary apparatus 105 is connected to the heat source apparatus at two locations: the liquid inlet P12 and the liquid outlet P22. The liquid inlet P12 is connected to the pipe 12 that is branched at the main branching point P11 from the trunk pipe 11 through which the heating medium of the air conditioning system flows. The liquid outlet P22 is connected to the pipe 22 that is merged at the main merging point P21 with the trunk pipe 21 through which the heating medium of the air conditioning system flows.

The load apparatus 102 is connected to the intermediary apparatus 105 at two locations: the liquid inlet P14 and the liquid outlet P24. The liquid inlet P14 is connected to the liquid outlet P13 of the intermediary apparatus 105 by a pipe 14B. The liquid outlet P24 is connected to the liquid inlet P23 of the intermediary apparatus 105 by a pipe 24B.

The flow of the heating medium will be described with reference to FIG. 14. The arrows illustrated in FIG. 14 indicate the flow direction of the heating medium. The heating medium pumped by the pump WP of FIG. 1 flows in the trunk pipe 11. A part of the heating medium that flows in the trunk pipe 11 flows into the intermediary apparatus 105 from the liquid inlet P12 through the pipe 12 branched at the main branching point P11.

The heating medium (cold water) flowing from the liquid inlet P12 flows through the pipe 13 into the liquid-liquid heat exchanger 3, and exchanges heat with the heating medium downstream of the indoor heat exchanger 2, and thereby the temperature thereof is increased. The heating medium whose temperature has increased flows through the pipe 14A and reaches the liquid outlet P13. The heating medium that has reached the liquid outlet P13 flows out of the intermediary apparatus 105 into the pipe 14B.

The heating medium that flows in the pipe 14B flows into the load apparatus 102 from the liquid inlet P14. The heating medium that has flowed into the load apparatus 102 flows through the pipe 14C into the indoor heat exchanger 2. The heating medium that has flowed into the indoor heat exchanger 2 exchanges heat with air to cool an indoor space. The heating medium that has exchanged heat with air in the indoor heat exchanger 2 increases in temperature, flows through the pipe 24C and reaches the liquid outlet P24. The heating medium that has reached the liquid outlet P24 flows out of the load apparatus 102 and reaches the pipe 24B. The heating medium flows through the pipe 24B and reaches the liquid inlet P23 of the intermediary apparatus 103.

The heating medium that has reached the liquid inlet P23 flows through the pipe 24A and reaches the branching point P31. The heating medium that has reached the branching point P31 is branched to flow in the pipes 31 and 32. The heating medium that flows in the pipe 32 exchanges heat in the liquid-liquid heat exchanger 3 with the heating medium on the upstream of the indoor heat exchanger 2, and thereby, the temperature thereof is decreased. The heating medium whose temperature has decreased flows through the pipe 33 and reaches the merging point P32. After the heating medium flows through the pipe 31 and reaches the merging point P32, it is mixed with the heating medium that flows in the pipe 33, and thereby, the temperature thereof is decreased. The heating medium that has reached the merging point P32 flows through the pipe 23 and reaches the liquid outlet P22.

The heating medium that has reached the liquid outlet P22 flows out of the intermediary apparatus 105 into the pipe 22. The heating medium that flows in the pipe 22 is merged at the main merging point P21 with the heating medium that flows in the trunk pipe 21. The heating medium merged in the trunk pipe 21 flows into the heat source apparatus 201 in FIG. 1 where it is cooled again.

As described in the fourth embodiment, by adding the intermediary apparatus 105 to an existing air conditioning system, it is also possible to change the temperature of the heating medium to be supplied to the indoor heat exchanger 2.

Fifth Embodiment

Figure 15:
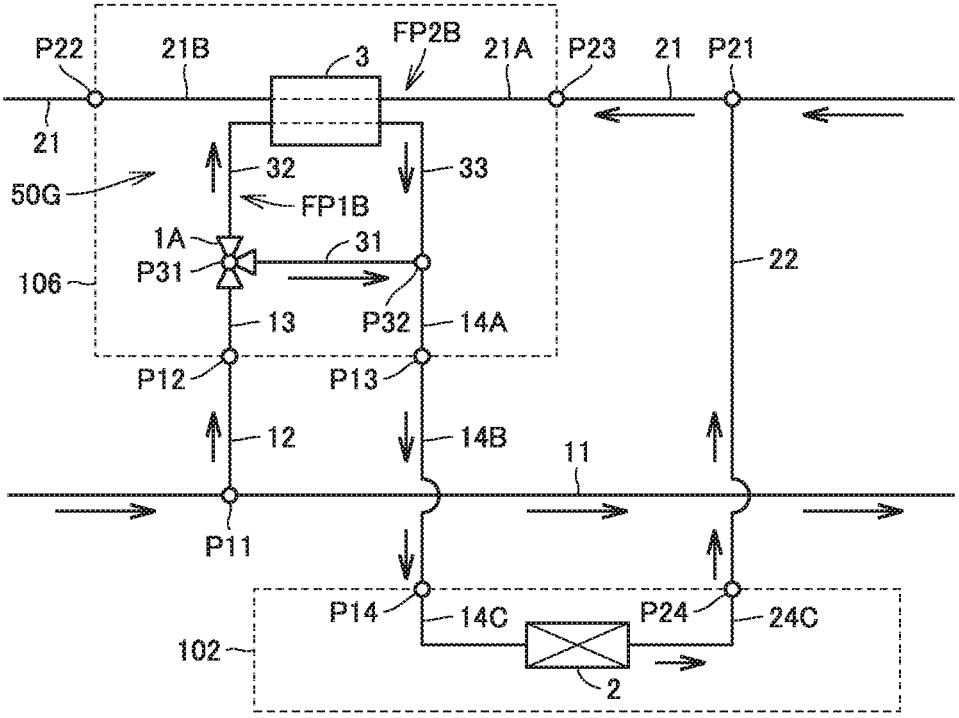
FIG. 15 is a diagram illustrating a flow path of a load apparatus 102 and an intermediary apparatus 106 and a flow of a heating medium according to a fifth embodiment.

FIG. 15 is a diagram illustrating a flow path of a load apparatus 102 and an intermediary apparatus 106 and a flow of a heating medium according to a fifth embodiment. As illustrated in FIG. 1, the heating medium is supplied from the heat source apparatus 201 to a plurality of load apparatuses 101-1 to **101-*n* through the trunk pipe 11 and returned to the heat source apparatus 201 through the trunk pipe 21. In the example illustrated in FIG. 15, a pipe FP1B and a pipe FP2B in the intermediary apparatus 106 correspond to the pipe FP1 and the pipe FP2 in the intermediary apparatus 103 illustrated in FIG. 9 according to the second embodiment, respectively. The pipe FP2B is a part of the trunk pipe 21, and the pipe FP1B constitutes a flow path that is branched from the trunk pipe 11 for supplying the heating medium to the indoor heat exchanger 2. The pipe FP1B may be a part of the trunk pipe 11, and the pipe FP2B may be a part of the pipe 22 for returning the liquid medium from the indoor heat exchanger 2 to the trunk pipe 21. Since the configuration of the load apparatus 102** is the same as that in the second embodiment, the description thereof will not be repeated.

The intermediary apparatus 106 includes a liquid-liquid heat exchanger 3, a first path from the liquid inlet P12 to the liquid outlet P13, and a second path from the liquid inlet P23 to the liquid outlet P22. The first path includes a pipe 13 that connect the liquid inlet P12 and the branching point P31 to each other, a pipe 31 that connects the branching point P31 and the merging point P32 to each other, a pipe 32 that connects the branching point P31 and the liquid-liquid heat exchanger 3 to each other, a pipe 33 that connects the liquid-liquid heat exchanger 3 and the merging point P32 to each other, and a pipe 14A that connects the merging point P32 and the liquid outlet P13 to each other. The second path includes a trunk pipe 21A that connects the liquid inlet P23 and the liquid-liquid heat exchanger 3 to each other and a trunk pipe 21B that connects the liquid-liquid heat exchanger 3 and the liquid outlet P22 to each other.

The intermediary apparatus 106 includes a flow rate distribution valve 1A that adjusts the flow rate at which the heating medium flowing from the pipe 13 into the branching point P31 is branched to flow in the pipe 31 and the pipe 32. Although FIG. 15 illustrates a configuration in which the flow rate distribution valve 1A is disposed at the branching point P31, it may be modified in the same manner as in the examples illustrated in FIGS. 3 to 6. Although the flow rate regulator is disposed in the pipe 32 as illustrated in FIGS. 3 to 6, it may be disposed in the pipe 33.

The intermediary apparatus 106 is connected to the trunk pipe for conveying the heating medium of the air conditioning system at three locations: the liquid inlet P12, the liquid inlet P23 and the liquid outlet P22. The liquid inlet P12 is connected to a pipe 12 branched at the main branching point P11 from the trunk pipe 11 through which the heating medium of the air conditioning system flows. The intermediary apparatus 106 is inserted into the trunk pipe 21 at an intermediate point. Specifically, the liquid inlet P23 is connected to an upstream side of the trunk pipe 21, and the liquid outlet P22 is connected to a downstream side of the trunk pipe 21.

The liquid inlet P14 of the load apparatus 102 is connected to the liquid outlet P13 of the intermediary apparatus 106 by the pipe 14B, and the liquid outlet P24 of the load apparatus 102 is connected to the main merging point P21 of the trunk pipe 21 by the pipe 22.

The flow of the heating medium will be described with reference to FIG. 15. The arrows illustrated in FIG. 15 indicate the flow direction of the heating medium. The heating medium pumped by the pump WP of FIG. 1 flows in the trunk pipe 11. A part of the heating medium that flows in the trunk pipe 11 flows into the intermediary apparatus 106 from the liquid inlet P12 through the pipe 12 branched at the main branching point P11.

The heating medium that has flowed from the liquid inlet P12 flows through the pipe 13 and reaches the branching point P31. A part of the heating medium that has reached the branching point P31 flows in the pipe 31, and the remainder flows in the pipe 32. The heating medium that flows in the pipe 32 exchanges heat in the liquid-liquid heat exchanger 3 with the heating medium that flows in the trunk pipe 21, and thereby, the temperature thereof is increased. The heating medium whose temperature has increased flows through the pipe 33 and reaches the merging point P32. After the heating medium flows through the pipe 31 and reaches the merging point P32, it is mixed with the heating medium that flows in the pipe 33, and thereby, the temperature thereof is increased. The heating medium merged at the merging point P32 flows through the pipe 14A and reaches the liquid outlet P13. The heating medium that has reached the liquid outlet P13 flows out of the intermediary apparatus 106 and flows in the pipe 14B.

The heating medium flows through the pipe 14B and flows into the load apparatus 102 from the liquid inlet P14. The heating medium that has flowed into the load apparatus 102 flows through the pipe 14C into the indoor heat exchanger 2. The heating medium that has flowed into the indoor heat exchanger 2 exchanges heat with air to cool an indoor space. The heating medium that has exchanged heat with air in the indoor heat exchanger 2 increases in temperature, flows through the pipe 24C and reaches the liquid outlet P24. The heating medium that has reached the liquid outlet P24 flows out of the load apparatus 102 and flows in the pipe 22.

The heating medium that flows in the pipe 22 is merged with the heating medium that flows in the trunk pipe 21 at the main merging point P21. The merged heating medium flows through the main outlet pipe and reaches the liquid inlet P23 of the intermediary apparatus 106. The heating medium having reached the liquid inlet P23 flows through the pipe 21A into the liquid-liquid heat exchanger 3. The heating medium flowing into the liquid-liquid heat exchanger 3 exchanges heat with the heating medium in the pipe FP1B, and thereby, the temperature thereof is decreased. The heating medium whose temperature has decreased flows through the pipe 21B and reaches the liquid outlet P22.

The heating medium that has reached the liquid outlet P22 flows through the trunk pipe 21 into the heat source apparatus 201 in FIG. 1 where it is cooled again.

As described in the fifth embodiment, it is also possible to improve the energy saving effect of an existing air conditioning system by inserting the intermediary apparatus into the trunk pipe.

Sixth Embodiment

Figure 16:
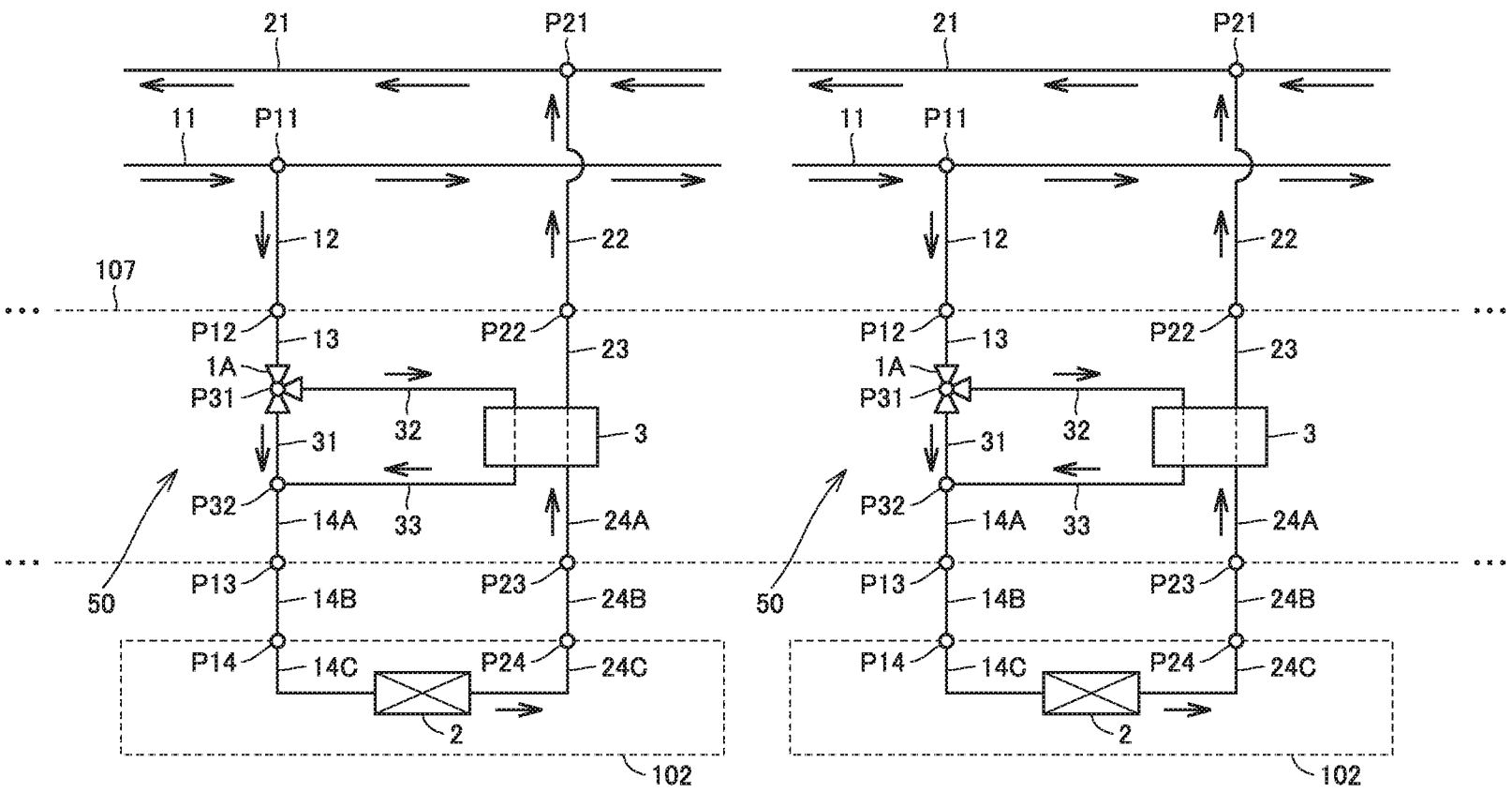
FIG. 16 is a diagram illustrating a flow path of a load apparatus 102 and an intermediary apparatus 107 and a flow of a heating medium according to a sixth embodiment.

FIG. 16 is a diagram illustrating a flow path of a load apparatus 102 and an intermediary apparatus 107 and a flow of a heating medium according to a sixth embodiment.

In the sixth embodiment, the air conditioning system includes a plurality of load apparatuses 102, and the intermediary apparatus 107 is interposed between the trunk pipe and the plurality of load apparatuses. The intermediary apparatus 107 is an integrated version of the intermediary apparatus 103 according to the second embodiment.

As illustrated in FIG. 1, the heating medium is supplied from the heat source apparatus 201 to the plurality of indoor heat exchangers 2 through the trunk pipe. In the example illustrated in FIG. 16, the intermediary apparatus 107 is disposed between the trunk pipes 11 and 21 for conveying the heating medium and the plurality of indoor heat exchangers 2, and includes a plurality of temperature adjustment apparatuses 50 corresponding respectively to the plurality of indoor heat exchangers 2. Note that the intermediary apparatus 107 may include any one of the temperature adjustment apparatuses illustrated in FIGS. 3 to 6 and 13 instead of the temperature adjustment apparatus 50. Since the configuration of the component corresponding to the intermediary apparatus 103 and the flow of the heating medium have been described in the second embodiment, the description thereof will not be repeated. As illustrated in FIG. 16, the intermediary apparatus 103 illustrated in FIG. 9 is used to perform the heat exchange with the liquid-liquid heat exchanger 3, the intermediary apparatus 105 illustrated in FIG. 14 may also be used.

Since a plurality of intermediary apparatuses are integrated in the sixth embodiment, when an intermediary apparatus cannot be disposed around each load apparatus 102 but may be disposed at another location, the intermediary apparatus may be disposed at that location.

Figure 17:
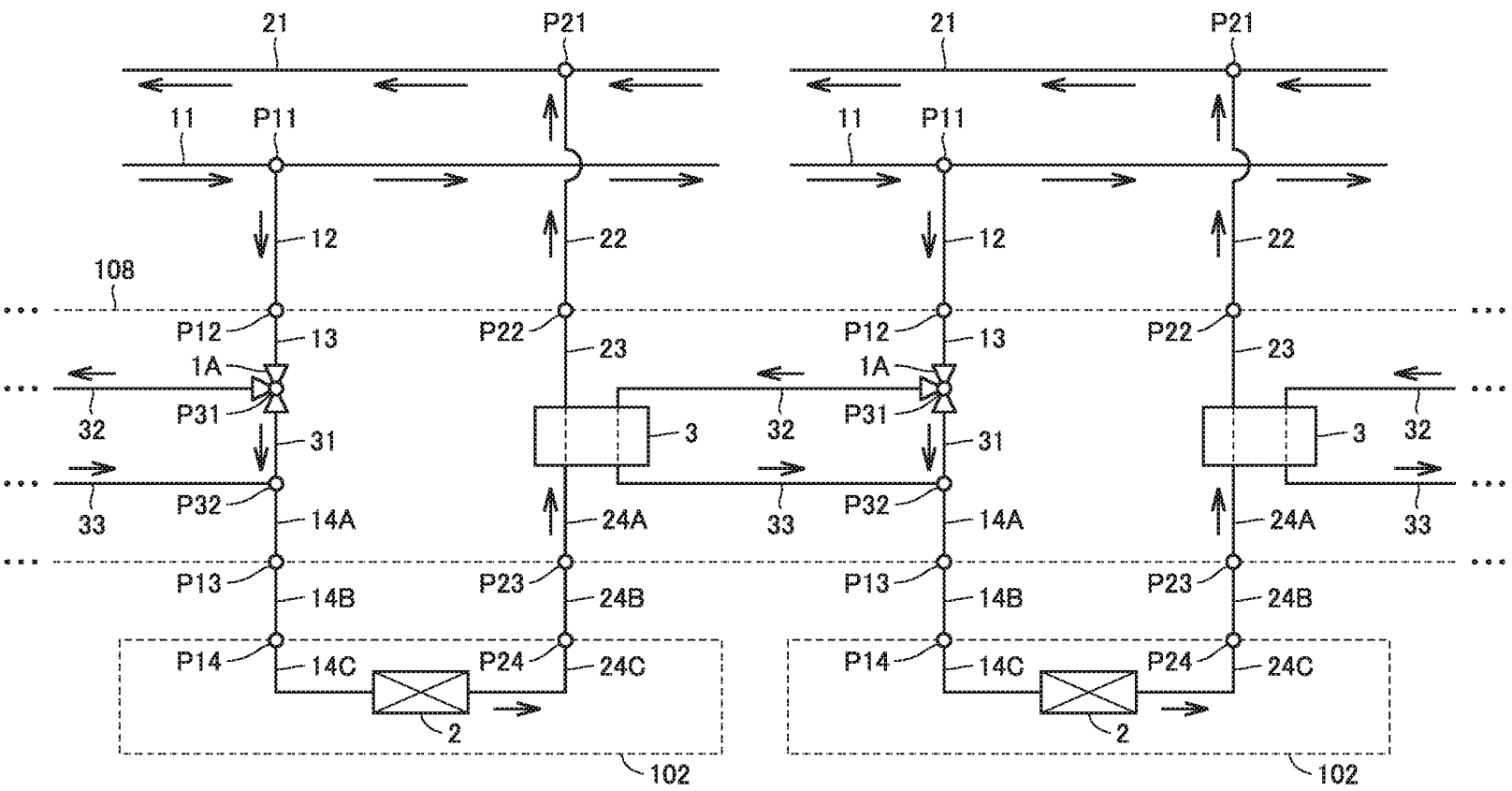
FIG. 17 is a diagram illustrating a flow path of a load apparatus 102 and an intermediary apparatus 108 and a flow of a heating medium according to a modification of the sixth embodiment.

FIG. 17 is a diagram illustrating a flow path of a load apparatus 102 and an intermediary apparatus 108 and a flow of the heating medium according to a modification of the sixth embodiment.

In the modification of the sixth embodiment, the air conditioning system includes a plurality of load apparatuses 102, and the intermediary apparatus 108 is interposed between the trunk pipes and the plurality of load apparatuses. In the intermediary apparatus 108, the heating medium flowing in the pipe 32 which is connected to the branching point P31 of the intermediary apparatus 107 according to the sixth embodiment is connected to the liquid-liquid heat exchanger 3 in a different system so as to exchange heat. The heating medium after the heat exchange flows in the pipe 33 and is merged at the merging point P32 of the original system with the heating medium that flows in the pipe 31. The modification is similar to the sixth embodiment in the configuration and the flow of the heating medium except for heat exchange in the liquid-liquid heat exchanger 3. As illustrated in FIG. 17, the intermediary apparatus 103 illustrated in FIG. 9 is used to perform the heat exchange with the liquid-liquid heat exchanger 3, the intermediary apparatus 105 illustrated in FIG. 14 may also be used.

Seventh Embodiment

Figure 18:
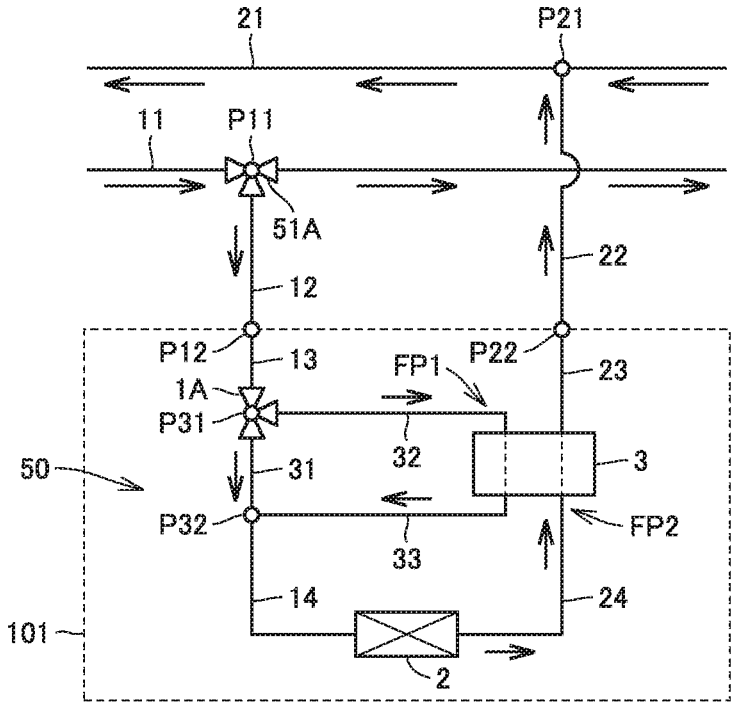
FIG. 18 is a diagram illustrating a flow path of a load apparatus and a flow of a heating medium according to a seventh embodiment.

FIG. 18 is a diagram illustrating a flow path of a load apparatus and a flow of a heating medium according to a seventh embodiment. In the seventh embodiment, a component configured to adjust a flow rate of the heating medium is added to the load apparatus in the first to sixth embodiments. With the addition of this configuration, it is possible to simultaneously adjust the temperature and the flow rate of the heating medium, which makes it possible to simultaneously adjust the temperature and the humidity of an indoor space.

In the seventh embodiment, the air conditioning system includes a flow rate distribution valve 51A that adjusts the flow rate of the heating medium that flows into the indoor heat exchanger 2. As illustrated in FIG. 1, the heating medium is supplied from the heat source apparatus 201 to the plurality of load apparatuses 101-1 to 101-*n* through the trunk pipes 11 and 21.

Figure 19:
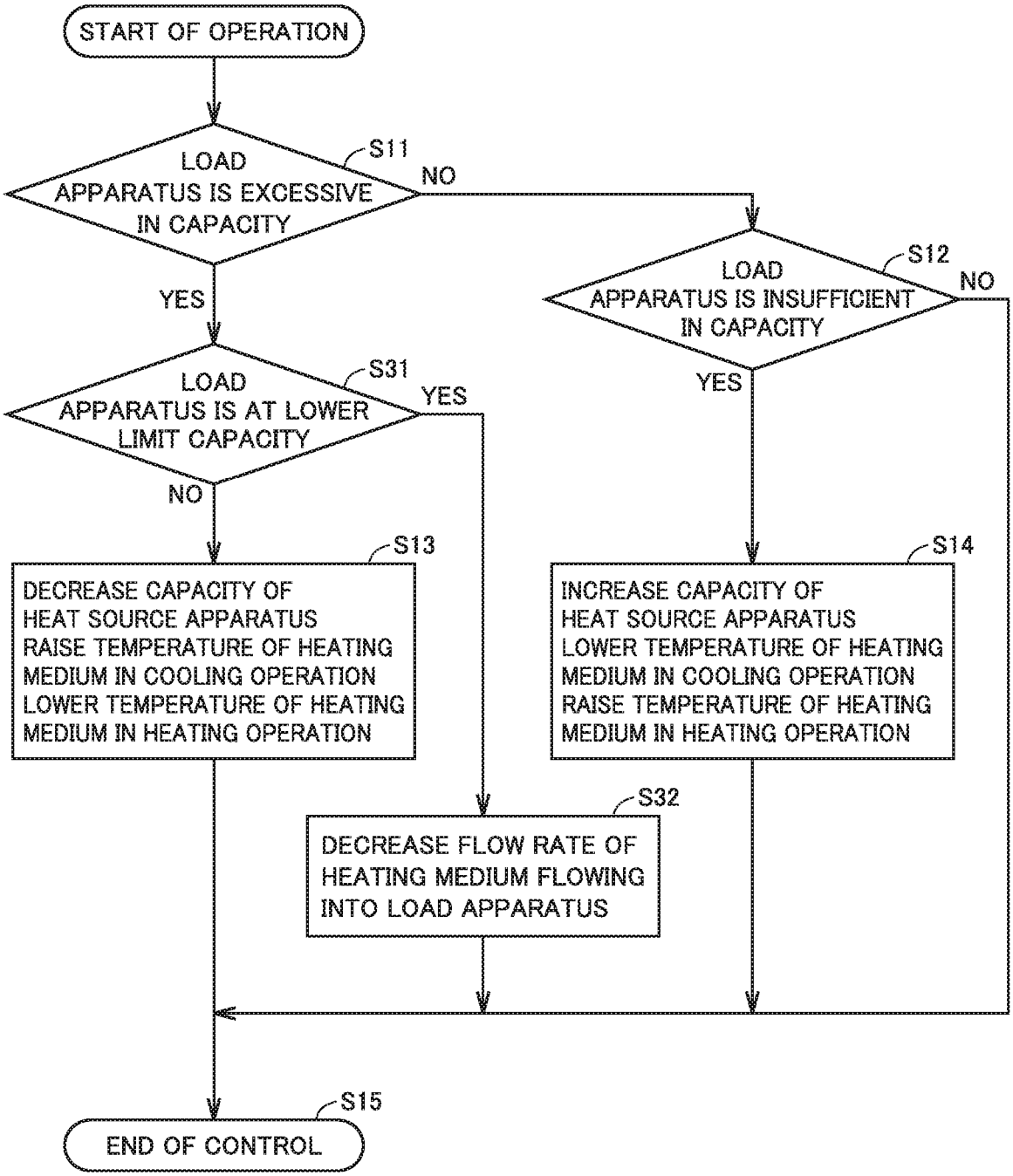
FIG. 19 is a flowchart illustrating a modification in which a flow rate control of a load apparatus is added to the control of FIG. 8.

FIG. 19 is a flowchart illustrating a modification in which a flow rate control of the load apparatus is added to the control of FIG. 8. Compared with the flowchart of FIG. 8, the flowchart of FIG. 19 is added with processing steps S31 and S32.

With reference to FIG. 19, after any of load apparatuses 101-1 to 101-*n* is actuated to operate, the controller 202 determines in step S11 whether or not the load apparatus 101 is excessive in capacity.

If the load apparatus 101 after the actuation is excessive in capacity (YES in step S11), the controller 202 determines in step S31 whether or not the load apparatus 101 is at a lower limit capacity. If the load apparatus 101 is at the lower limit capacity (YES in step S31), the controller 202 decreases the flow rate of the heating medium flowing into the load apparatus 101. On the other hand, if the load apparatus 101 is not at the lower limit capacity, the controller 202 lowers the capacity of the load apparatus 101.

Since the other steps have been described with reference to FIG. 8, the description thereof will not be repeated.

Figure 20:
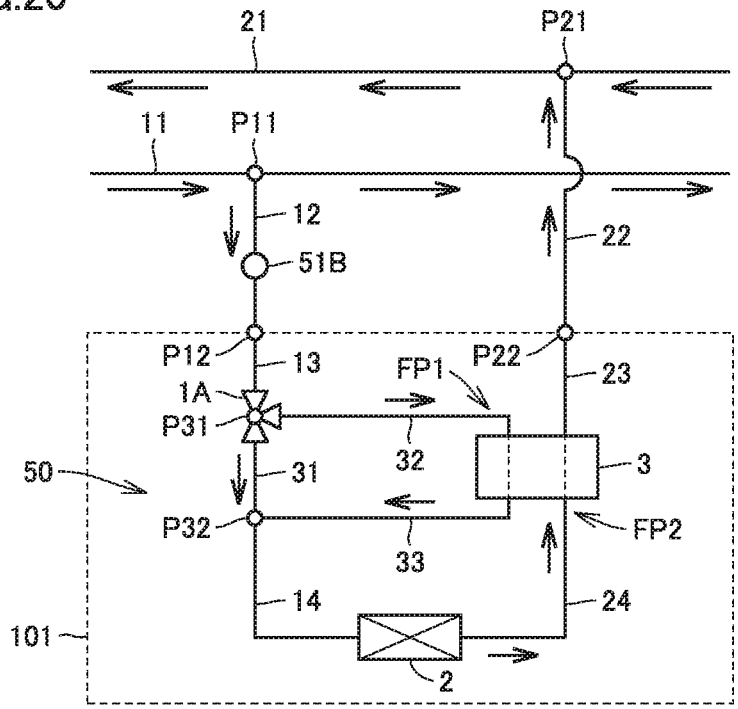
FIG. 20 is a diagram illustrating a configuration of a first modification of the load apparatus and the flow rate regulator according to a seventh embodiment.
Figure 21:
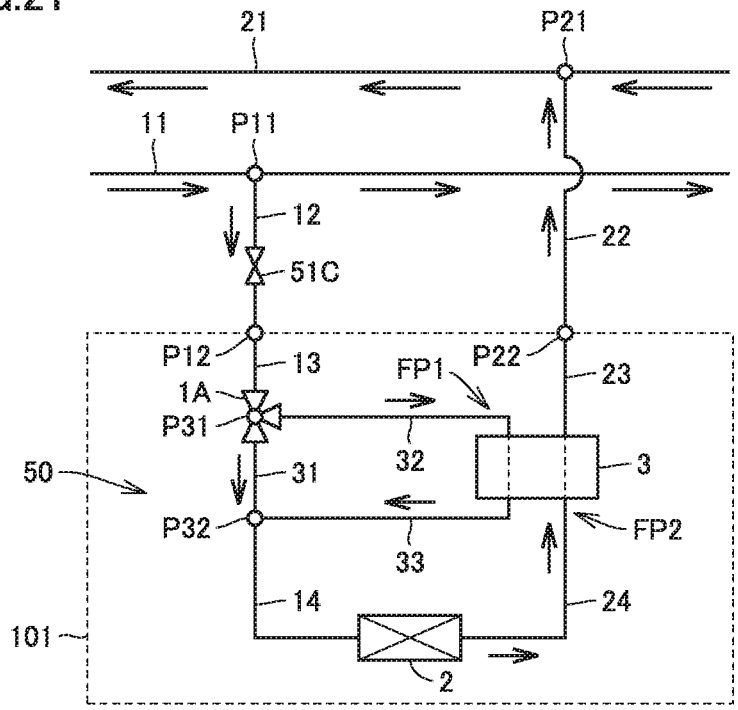
FIG. 21 is a diagram illustrating a configuration of a second modification of the load apparatus and the flow rate regulator according to the seventh embodiment.
Figure 22:
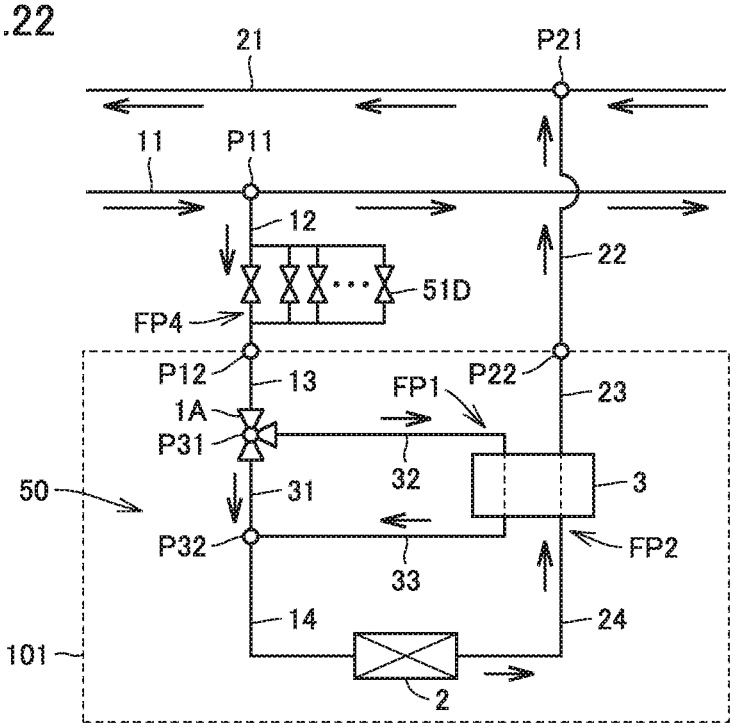
FIG. 22 is a diagram illustrating a configuration of a third modification of the load apparatus and the flow rate regulator according to the seventh embodiment.

As illustrated in FIG. 18, the flow rate distribution valve MA is disposed at the main branching point P11 of the trunk pipe 11, it may be modified in the same manner as in the examples illustrated in FIGS. 20 to 22.

In the example illustrated in FIG. 20, in addition to the flow rate distribution valve 1A, a flow regulation valve 51B is further disposed in the pipe 12 between the pipe FP1 and the trunk pipe 11. Note that the flow control valve 51B may be disposed in the pipe 22 between the pipe FP2 and the trunk pipe 21.

In the example illustrated in FIG. 21, in addition to the flow rate distribution valve 1A, a cutoff valve 51C is further disposed in the pipe 12 between the pipe FP1 and the trunk pipe 11 and configured to operate intermittently. Note that the cutoff valve 51C may be disposed in the pipe 22 between the pipe FP2 and the trunk pipe 21.

In the example illustrated in FIG. 22, in addition to the flow rate distribution valve 1A, a plurality of pipes FP4 (fourth branch pipes) are further disposed between the pipe FP1 and the trunk pipe 11 and connected in parallel to each other, and a plurality of cutoff valves 51D are further provided in the plurality of pipes FP4, respectively. Note that the plurality of pipes FP4 and the plurality of cutoff valves 51D may be disposed between the pipe FP2 and the trunk pipe 21.

Although the flow rate regulator is disposed in the pipe 12 as illustrated in FIGS. 20 to 22, it may be disposed in any of the pipes 13, 14, 22 to 24.

Although in the example illustrated in each of FIGS. 18 and 20 to 22, the flow rate regulator is added to the load apparatus 101 of the first embodiment, a similar flow rate regulator may be provided in the second to sixth embodiments.

Eighth Embodiment

Figure 23:
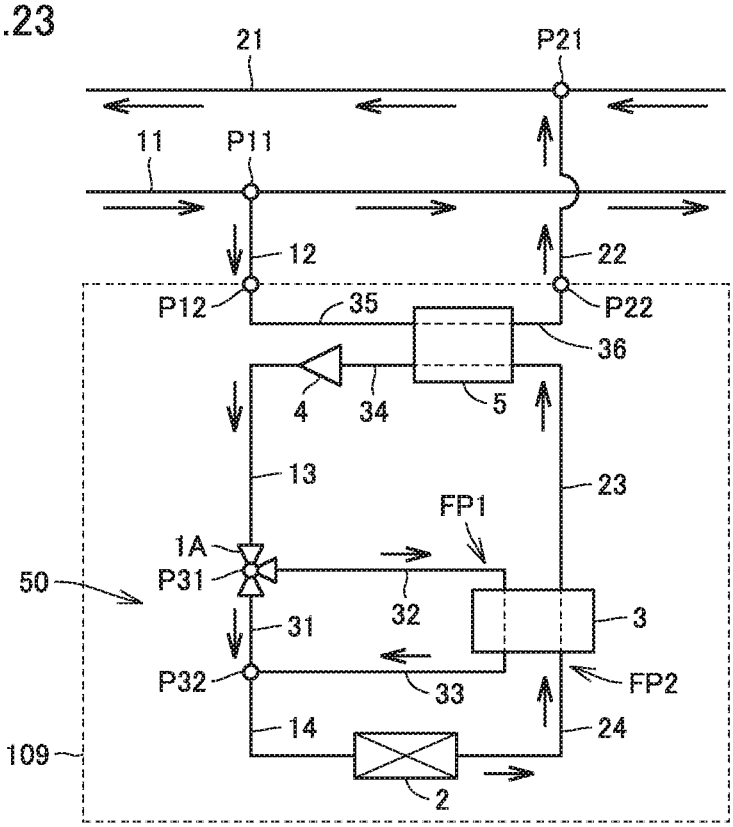
FIG. 23 is a diagram illustrating a flow path of a load apparatus 109 and a flow of a heating medium according to an eighth embodiment.

FIG. 23 is a diagram illustrating a flow path of a load apparatus 109 and a flow of a heating medium according to an eighth embodiment.

With reference to FIG. 23, the load apparatus 109 includes a flow path for circulating the heating medium in the order of the pump 4, the branching point P31, the merging point P32, the indoor heat exchanger 2, the liquid-liquid heat exchanger 3 and a third heat exchanger 5, and a flow path for circulating the heating medium from the trunk pipe 11 via the liquid inlet P12, the third heat exchanger 5 and the liquid outlet P22 to the trunk pipe 21.

The flow path starting from the pump 4 includes a pipe 13 that connects the pump 4 and the branching point P31 to each other, a pipe 31 that connects the branching point P31 and the merging point P32 to each other, a pipe 32 that connects the branching point P31 and the liquid-liquid heat exchanger 3 to each other, a pipe 33 that connects the liquid-liquid heat exchanger 3 and the merging point P32 to each other, a pipe 14 that connects the merging point P32 and the indoor heat exchanger 2 to each other, a pipe 24 that connects the indoor heat exchanger 2 and the liquid heat exchanger 3 to each other, a pipe 23 that connects the liquid-liquid heat exchanger 3 and the third heat exchanger 5 to each other, and a pipe 34 that connects the third heat exchanger 5 and the pump to each other.

The flow path starting from the liquid inlet P12 includes a pipe 35 that connects the liquid inlet P12 and the third heat exchanger 5 to each other, and a pipe 36 that connects the third heat exchanger 5 and the liquid outlet P22 to each other.

The load apparatus 109 includes a flow rate regulator that adjusts the flow rate at which the heating medium flowing from the pipe 13 into the branching point P31 is branched to flow in the pipe 31 and the pipe 32. FIG. 23 illustrates a configuration in which the flow rate distribution valve 1A is disposed at the branching point P31, it may be modified in the same manner as in the examples illustrated in FIGS. 3 to 6. Although the flow rate regulator 1 is disposed in the pipe 32 as illustrated in FIGS. 3 to 6, it may be disposed in the pipe 33. Although as illustrated in FIG. 23, a configuration similar to that illustrated in FIG. 2 according to the first embodiment is used to perform the heat exchange in the liquid-liquid heat exchanger 3, the configuration similar to that illustrated in FIG. 13 according to the third embodiment may also be used.

The load apparatus 109 is connected to the trunk pipes 11 and 21 of the air conditioning system at two locations: the liquid inlet P12 and the liquid outlet P22. The liquid inlet P12 is connected to the pipe 12 branched at the main branching point P11 from the trunk pipe 11 through which the heating medium of the air conditioning system flows. The liquid outlet P22 is connected to the pipe 22 branched at the main merging point P21 from the trunk pipe 21 through which the heating medium of the air conditioning system flows.

The flow of the heating medium will be described with reference to FIG. 23. The arrows illustrated in FIG. 23 indicate the flow direction of the heating medium.

The heating medium pumped by the pump WP of FIG. 1 flows in the trunk pipe 11. A part of the heating medium that flows in the trunk pipe 11 flows through the pipe 12 branched at the main branching point P11 and reaches the liquid inlet P12. The heating medium that has reached the liquid inlet P12 flows through the pipe 35 into the third heat exchanger 5. The heating medium that has flowed into the third heat exchanger 5 exchanges heat with the heating medium on a use side of the load apparatus and cools the heating medium on the use side. The heating medium that has exchanged heat with the heating medium on the use side in the third heat exchanger 5 flows through the pipe 37 and reaches the liquid outlet P22. The heating medium that has reached the liquid outlet P22 flows out of the load apparatus 109 into the pipe 22. The heating medium that flows in the pipe 22 is merged at the main merging point P21 with the heating medium that flows in the trunk pipe 21. The heating medium merged in the trunk pipe 21 flows into the heat source apparatus 201 in FIG. 1 where it is cooled again.

Although FIG. 23 illustrates an example in which water or brine is adopted as the heating medium that flows in the trunk pipes 11 and 21, a refrigeration cycle using gas refrigerant may be adopted as the heat source apparatus in the eighth embodiment. In this case, the refrigerant is transported not by the pump WP but by a compressor, and it becomes a low-pressure refrigerant in an expansion apparatus provided in any of trunk pipes 11, 12, and 35 or any area outside the drawing, flows into the third heat exchanger 5, and exchanges heat with the heating medium on the use side.

The heating medium pumped by the pump 4 flows through the pipe 13 and reaches the branching point P31. The heating medium that has reached the branching point P31 is branched to flow in the pipe 31 and the pipe 32. The heating medium in the pipe FP1 that flows in the pipe 32 exchanges heat in the liquid-liquid heat exchanger 3 with the heating medium in the pipe FP2 on the downstream of the indoor heat exchanger 2, and thereby, the temperature thereof is increased. The heating medium whose temperature has increased flows through the pipe 33 and reaches the merging point P32. After the remaining heating medium flows through the pipe 31 and reaches the merging point P32, it is mixed with the heating medium that flows in the pipe 33, and thereby, the temperature thereof is increased. The heating medium that has reached the merging point P32 flows through the pipe 14 into the indoor heat exchanger 2.

The heating medium that has flowed into the indoor heat exchanger 2 exchanges heat with air to cool an indoor space. The heating medium that has exchanged heat with air in the indoor heat exchanger 2 increases in temperature, and flows through the pipe 24 into the liquid-liquid heat exchanger 3. The heating medium flowing into the liquid-liquid heat exchanger 3 exchanges heat with the heating medium on the upstream of the pipe FP1, and thereby, the temperature thereof is decreased. The heating medium whose temperature has decreased flows in the pipe 23 into the third heat exchanger 5. The heating medium that has flowed into the third heat exchanger 5 exchanges heat with the heating medium that flows in the pipe 35 branched from the trunk pipe 11, and thereby, the temperature thereof is decreased. The heating medium whose temperature has decreased flows in the pipe 34 into the pump 4 where it is pumped out into the pipe 13 again.

Figure 24:
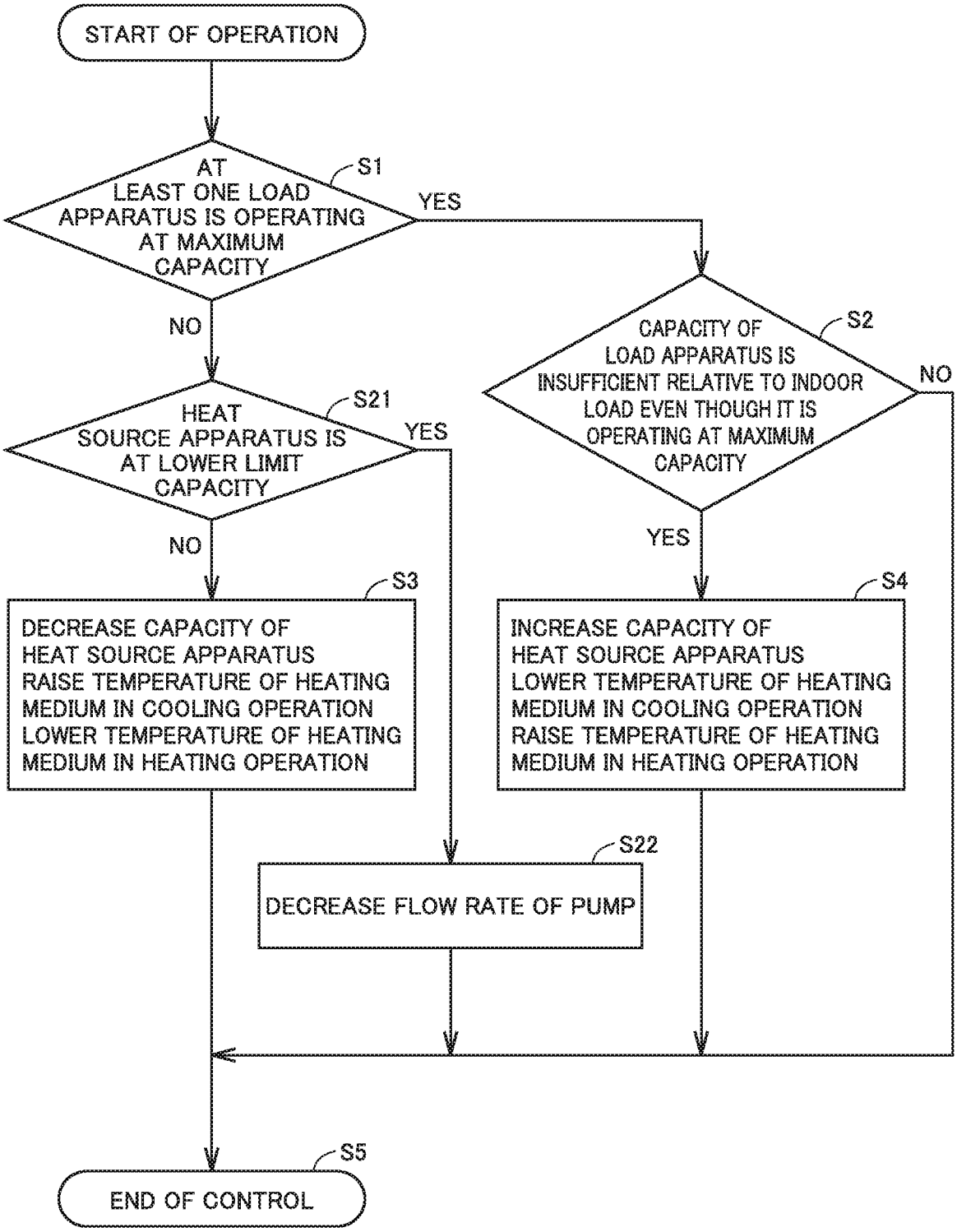
FIG. 24 is a flowchart illustrating a modification in which a pump control is added to the control of FIG. 7.

FIG. 24 is a flowchart illustrating a modification in which the control of the pump is added to the control of FIG. 7. In the control of the flowchart illustrated in FIG. 7, the capacity is adjusted in response to the temperature change of the load apparatus 101 and the heat source apparatus 201. Either the load apparatus or the heat source apparatus has a lower limit capacity, and if the air conditioning load is equal to or lower than the lower limit capacity, it causes a problem that the electric power is wasted or the user may feel uncomfortable due to the intermittent air conditioning.

Therefore, compared with the flowchart of FIG. 7, the flowchart of FIG. 24 is added with processing steps S21 and S22.

With reference to FIG. 24, the controller 202 determines in step S1 whether or not each of the plurality of load apparatuses 101-1 to **101-*n* is operating at the maximum capacity. If all of the load apparatuses 101-1 to 101-*n* are not operating at the maximum capacity (NO in step S1), the controller 202 determines in step S21 whether or not the heat source apparatus 201** is at a lower limit capacity.

If the heat source apparatus 201 is at the lower limit capacity (YES in step S21), the controller 202 reduces the flow rate of the pump WP in step S22, and the control is ended in step S5. Since the capacity of the air conditioning system may be further reduced by reducing the flow rate of the pump WP, the power consumption at the time when the air conditioning load is low may be improved, and the discomfort to the user may be suppressed.

On the other hand, if the heat source apparatus 201 is not at the lower limit capacity (NO in step S21), the controller 202 controls the heat source apparatus 201 to lower the capacity of the heat source apparatus 201 in step S3, and the control is ended in step S5.

If one or more of the load apparatuses 101-1 to **101-*n* is operating at the maximum capacity (YES in step S1), the processes in steps S2 and S4 are executed. Since the processes in steps S2 and S4 have been described with reference to FIG. 7**, the description will not be repeated.

Figure 25:
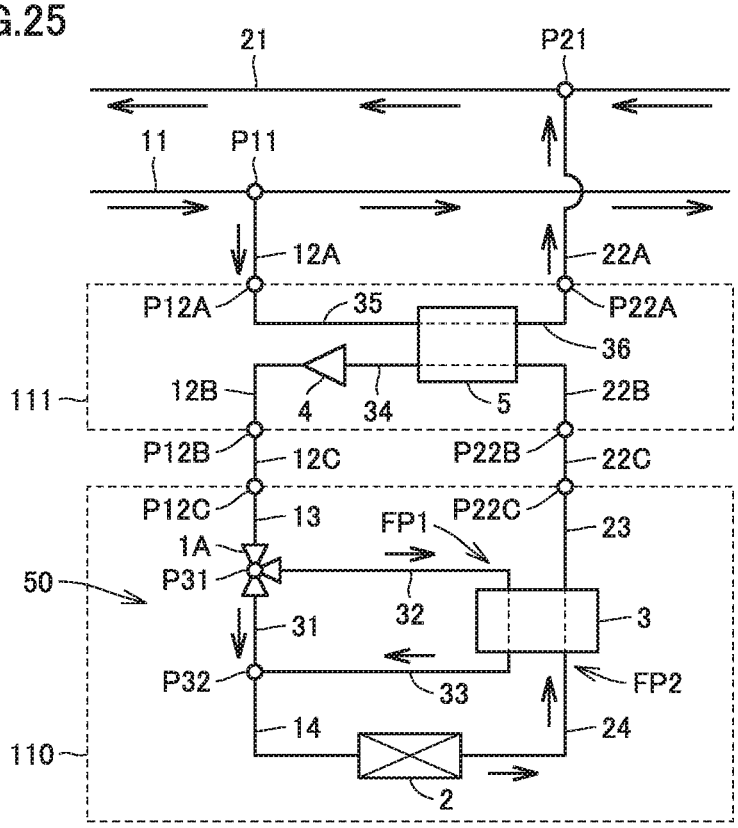
FIG. 25 is a diagram illustrating a modification of the flow path according to the eighth embodiment.

FIG. 23 illustrates a configuration in which the components of the eighth embodiment is accommodated in a single load apparatus 109. However, as illustrated in FIG. 25, the components of the eighth embodiment may be divided into a load apparatus 110 and an intermediary apparatus 111. In this case, the intermediary apparatus 111 may be configured in the same manner as that illustrated in FIG. 16 according to the sixth embodiment in which the intermediary apparatuses in a plurality of systems are grouped in one intermediary apparatus.

In the eighth embodiment, if a pump having a variable number of revolutions is used as the pump 4, the pump 4 may adjust the flow rate, which makes it possible to simultaneously adjust the temperature and humidity of an indoor space as in the seventh embodiment.

Furthermore, if the flow path in FIG. 23 is provided with a flow rate regulator configured to adjust the flow rate of the heating medium flowing to the third heat exchanger 5, it is possible to increase the adjustable range for the temperature and humidity of the indoor space. Such flow rate regulator may be the same as the flow rate distribution valve 51A that is disposed at the main branching point P11 of the trunk pipe 11 as illustrated in FIG. 18 according to the seventh embodiment, or the flow regulation valve 51B that is disposed in the pipe 12 as illustrated in FIG. 20, or the cutoff valve 51C that is disposed in the pipe 12 and configured to operate intermittently as illustrated in FIG. 21, or the cutoff valve 51D that is disposed in each of pipes which are branched from the pipe 12 and disposed in parallel to each other as illustrated in FIG. 22. Such flow rate regulator may be disposed in any of the pipes 12, 22, 35 and 36.

Ninth Embodiment

Figure 26:
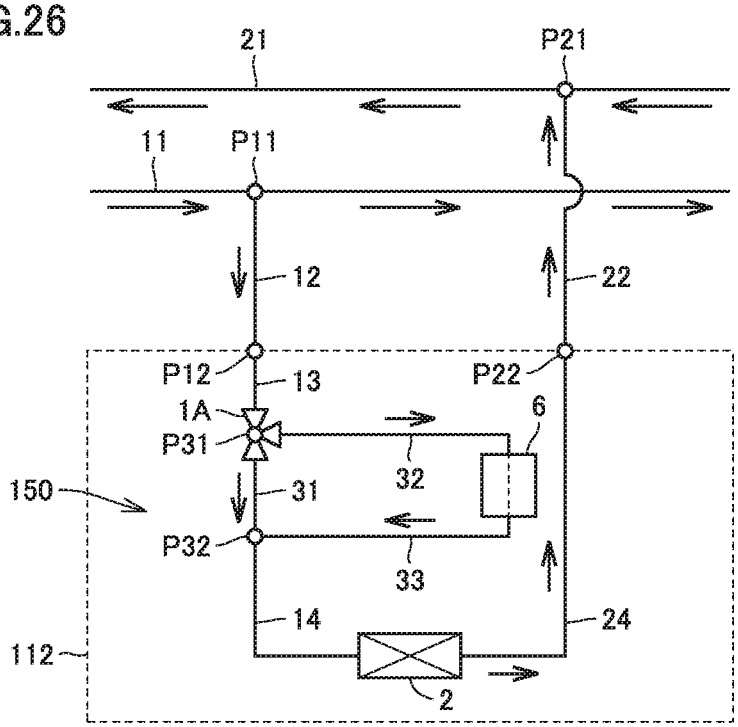
FIG. 26 is a diagram illustrating a flow path of a load apparatus and a flow of a heating medium according to a ninth embodiment.
Figure 27:
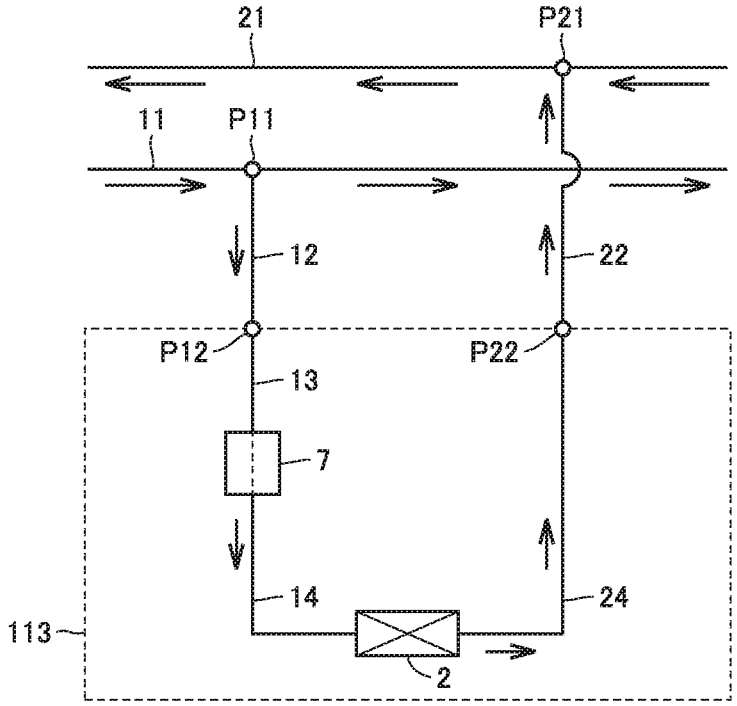
FIG. 27 is a diagram illustrating a configuration of a modification of the load apparatus according to the ninth embodiment.

FIG. 26 is a diagram illustrating a flow path of a load apparatus and a flow of a heating medium according to a ninth embodiment. The load apparatus 112 illustrated in FIG. 26 is obtained by replacing the liquid-liquid heat exchanger 3 in the load apparatus 101 illustrated in FIG. 1 according to the first embodiment with a heater 6. In response to the modification, the pipe 24 is modified to connect the indoor heat exchanger 2 and the liquid outlet P22 to each other. Since the other configurations and the flow of the heating medium are the same as those in the first embodiment, the description thereof will not be repeated. When the amount of heat generated by the heater 6 in FIG. 26 is variable, the configuration may be simplified like a heater 7 of a load apparatus 113 illustrated in FIG. 27. According to the configuration, the heater is required to consume the electric power, which may not be energy saving, but the effect of suppressing the discomfort may be sufficiently expected due to the ability of lowering the humidity in the indoor space.

Furthermore, by providing a mechanism for adjusting the flow rate of the heating medium flowing into the indoor heat exchanger 2, the temperature and humidity of an indoor space may be adjusted simultaneously.

The mechanism for adjusting the flow rate may be the same as the flow rate distribution valve 51A that is disposed at the main branching point P11 of the trunk pipe 11 as illustrated in FIG. 18 according to the seventh embodiment, or the flow regulation valve 51B that is disposed in the pipe 12 as illustrated in FIG. 20, or the cutoff valve 51C that is disposed in the pipe 12 and configured to operate intermittently as illustrated in FIG. 21, or the cutoff valve 51D that is disposed in each of pipes which are branched from the pipe 12 and disposed in parallel to each other as illustrated in FIG. 22. Such mechanism for adjusting the flow rate may be disposed in any of the pipes 13, 14, 22 and 24.

Each embodiment is applicable also to a refrigeration cycle apparatus. The refrigeration cycle apparatus is an apparatus including an intermediary apparatus and a heat source apparatus or an apparatus including a load apparatus and a heat source apparatus, and represented by an air conditioning apparatus. Examples of the refrigeration cycle apparatus, however, can include a showcase, a refrigerator, a freezer, a refrigerating storage, and a cold storage.

It should be understood that the embodiments disclosed herein are illustrative and non-restrictive in every respect. The scope of the present invention is defined by the terms of the claims rather than the description of the embodiments above and is intended to include any modifications within the scope and meaning equivalent to the terms of the claims.

The invention claimed is:

1. An air conditioning system comprising:

a heat source apparatus configured to heat or cool a liquid medium;

a controller;

a plurality of indoor heat exchangers, each of which is supplied with the liquid medium from the heat source apparatus and configured to exchange heat between the liquid medium and air; and a plurality of temperature adjustment apparatuses, each of which is disposed in association with a respective one of the plurality of indoor heat exchangers and configured to adjust the temperature of the liquid medium supplied to a respective one of the plurality of indoor heat exchangers, each of the plurality of temperature adjustment apparatuses being configured to variably adjust the amount of heat exchange between an inflow medium, which is the liquid medium supplied to a corresponding indoor heat exchanger, and an outflow medium, which is the liquid medium discharged from the corresponding indoor heat exchanger, and wherein the controller is configured to determine whether, in the plurality of temperature adjustment apparatuses, there is no temperature adjustment apparatus in which the amount of heat exchange between the inflow medium and the outflow medium is set to the minimum in a variable range, and when the controller determines that there is no temperature adjustment apparatus in which the amount of heat exchange between the inflow medium and the outflow medium is set to the minimum, reduce the heating capacity or the cooling capacity so as to change the temperature of the liquid medium.

2. The air conditioning system according to claim 1, wherein each of the plurality of temperature adjustment apparatuses includes:

a first pipe through which the liquid medium flows, the first pipe being branched into a first branch pipe and a second branch pipe, the first branch pipe and the second branch pipe being thereafter merged again;

a second pipe through which the liquid medium flows;

a liquid-liquid heat exchanger configured to exchange heat between the liquid medium that flows in the second branch pipe and the liquid medium that flows in the second pipe; and a flow rate regulator, having at least one valve, configured to adjust a flow rate of the liquid medium that flows in the first branch pipe and a flow rate of the liquid medium that flows in the second branch pipe, one of the first pipe and the second pipe is a pipe configured to supply the liquid medium from the heat source apparatus to the indoor heat exchanger, and the other of the first pipe and the second pipe is a pipe configured to return the liquid medium from the indoor heat exchanger to the heat source apparatus, when in the plurality of temperature adjustment apparatuses, there is no temperature adjustment apparatus in which the flow rate regulator is set in such a manner that the flow rate of the liquid medium that flows in the first branch pipe and bypasses the liquid-liquid heat exchanger is maximum in a variable range, the heat source apparatus is configured to reduce the capacity for changing the temperature of the liquid medium.

3. The air conditioning system according to claim 2, wherein the at least one valve of the flow rate regulator of each of the plurality of temperature adjustment apparatuses includes a first flow rate distribution valve which is disposed at a branching point or a merging point of the first branch pipe and the second branch pipe and configured to adjust a ratio between the flow rate of the liquid medium that flows in the first branch pipe and the flow rate of the liquid medium that flows in the second branch pipe.

4. The air conditioning system according to claim 2, wherein the at least one valve of the flow rate regulator of each of the plurality of temperature adjustment apparatuses includes a first flow rate regulation valve which is disposed in the first branch pipe or the second branch pipe and configured to adjust a ratio between the flow rate of the liquid medium that flows in the first branch pipe and the flow rate of the liquid medium that flows in the second branch pipe.

5. The air conditioning system according to claim 2, wherein the at least one valve of the flow rate regulator of each of the plurality of temperature adjustment apparatuses includes a first cutoff valve which is disposed in the first branch pipe or the second branch pipe and configured to operate intermittently.

6. The air conditioning system according to claim 2, wherein the first pipe includes a plurality of third branch pipes which are connected in parallel to each other and configured to exchange heat with the liquid medium that flows in the second pipe, and the at least one valve of the flow rate regulator of each of the plurality of temperature adjustment apparatuses includes a plurality of first cutoff valves, each of which is disposed in a respective one of the plurality of third branch pipes.

7. The air conditioning system according to claim 6, wherein the liquid-liquid heat exchanger is configured to differ the amount of heat exchange in each of the plurality of third branch pipes.

8. The air conditioning system according to claim 2, wherein the liquid medium is supplied to the plurality of indoor heat exchangers and the plurality of temperature adjustment apparatuses from the heat source apparatus through a trunk pipe, and the at least one valve of the flow rate regulator of each of the plurality of temperature adjustment apparatuses further includes a flow rate distribution valve which is disposed at a branching point where the trunk pipe is branched into the first pipe or the second pipe.

9. The air conditioning system according to claim 2, wherein the liquid medium is supplied to the plurality of indoor heat exchangers and the plurality of temperature adjustment apparatuses from the heat source apparatus through a trunk pipe, and the at least one valve of the flow rate regulator of each of the plurality of temperature adjustment apparatuses further includes a flow rate regulation valve which is disposed between the first pipe or the second pipe and the trunk pipe.

10. The air conditioning system according to claim 2, wherein the liquid medium is supplied to the plurality of indoor heat exchangers and the plurality of temperature adjustment apparatuses from the heat source apparatus through a trunk pipe, and the at least one valve of the flow rate regulator of each of the plurality of temperature adjustment apparatuses further includes a cutoff valve which is disposed between the first pipe or the second pipe and the trunk pipe and configured to operate intermittently.

11. The air conditioning system according to claim 2, wherein the liquid medium is supplied to the plurality of indoor heat exchangers and the plurality of temperature adjustment apparatuses from the heat source apparatus through a trunk pipe, and the flow rate regulator of each of the plurality of temperature adjustment apparatuses includes a plurality of fourth branch pipes which are disposed between the first pipe or the second pipe and the trunk pipe and connected in parallel to each other, and the at least one valve of the flow rate regulator includes a plurality of cutoff valves, each of which is disposed in a respective one of the plurality of fourth branch pipes.

12. The air conditioning system according to claim 2, wherein the liquid medium is supplied to the plurality of indoor heat exchangers and the plurality of temperature adjustment apparatuses from the heat source apparatus through a first trunk pipe, and is returned to the heat source apparatus through a second trunk pipe, one of the first pipe and the second pipe is a part of one of the first trunk pipe and the second trunk pipe, and the other of the first pipe and the second pipe is a pipe which is branched from the other of the first trunk pipe and the second trunk pipe and configured to supply the liquid medium to the indoor heat exchanger.

13. An air conditioning system comprising:

a heat source apparatus configured to heat or cool a liquid medium;

a controller;

a plurality of indoor heat exchangers, each of which is supplied with the liquid medium from the heat source apparatus and configured to exchange heat between the liquid medium and air; and a plurality of temperature adjustment apparatuses, each of which is disposed in association with a respective one of the plurality of indoor heat exchangers and configured to adjust the temperature of the liquid medium supplied to a respective one of the plurality of indoor heat exchangers, each of the plurality of temperature adjustment apparatuses being configured to variably adjust the amount of heat exchange between an inflow medium, which is the liquid medium supplied to a corresponding indoor heat exchanger, and an outflow medium, which is the liquid medium discharged from the corresponding indoor heat exchanger, and wherein the controller is configured to determine whether (i) in the plurality of temperature adjustment apparatuses, there is at least one temperature adjustment apparatus in which the amount of heat exchange between the inflow medium and the outflow medium is set to the minimum in a variable range and (ii) the heat exchanging capacity of an indoor heat exchanger corresponding to the temperature adjustment apparatus in which the amount of heat exchange is set to the minimum in the variable range is smaller than an indoor load, and when the controller determines that there is at least one temperature adjustment apparatus in which the amount of heat exchange is set to the minimum and the heat exchanging capacity of the indoor heat exchanger corresponding to the temperature adjustment apparatus is small than the indoor load, increase the heating capacity or the cooling capacity for changing the temperature of the liquid medium.

14. An air conditioning system comprising:

a heat source apparatus configured to heat or cool a liquid medium;

a controller;

a plurality of indoor heat exchangers, each of which is supplied with the liquid medium from the heat source apparatus and configured to exchange heat between the liquid medium and air; and a plurality of temperature adjustment apparatuses, each of which is disposed in association with a respective one of the plurality of indoor heat exchangers and configured to adjust the temperature of the liquid medium supplied to a respective one of the plurality of indoor heat exchangers, each of the plurality of temperature adjustment apparatuses being configured to variably adjust the amount of heat exchange between an inflow medium, which is the liquid medium supplied to a corresponding indoor heat exchanger, and an outflow medium, which is the liquid medium discharged from the corresponding indoor heat exchanger, and an indoor heat exchanger in the plurality of indoor heat exchangers which has a heat exchanging capacity larger than an indoor load being configured to increase the amount of heat exchange of a corresponding temperature adjustment apparatus, wherein the controller is configured to determine whether, in the plurality of temperature adjustment apparatuses, there is no temperature adjustment apparatus in which the amount of heat exchange between the inflow medium and the outflow medium is set to the minimum in a variable range, and when the controller determines that there is no temperature adjustment apparatus in which the amount of heat exchange between the inflow medium and the outflow medium is set to the minimum, reduce the heating capacity or the cooling capacity so as to change the temperature of the liquid medium.

15. An air conditioning system comprising:

a heat source apparatus configured to heat or cool a liquid medium;

a controller;

a plurality of indoor heat exchangers, each of which is supplied with the liquid medium from the heat source apparatus and configured to exchange heat between the liquid medium and air; and a plurality of temperature adjustment apparatuses, each of which is disposed in association with a respective one of the plurality of indoor heat exchangers and configured to adjust the temperature of the liquid medium supplied to a respective one of the plurality of indoor heat exchangers, each of the plurality of temperature adjustment apparatuses being configured to variably adjust the amount of heat exchange between an inflow medium, which is the liquid medium supplied to a corresponding indoor heat exchanger, and an outflow medium, which is the liquid medium discharged from the corresponding indoor heat exchanger, and an indoor heat exchanger in the plurality of indoor heat exchangers which has a heat exchanging capacity smaller than an indoor load being configured to reduce the amount of heat exchange of a corresponding temperature adjustment apparatus, wherein the controller is configured to determine whether, in the plurality of temperature adjustment apparatuses, there is no temperature adjustment apparatus in which the amount of heat exchange between the inflow medium and the outflow medium is set to the minimum in a variable range, and when the controller determines that there is no temperature adjustment apparatus in which the amount of heat exchange between the inflow medium and the outflow medium is set to the minimum, reduce the heating capacity or the cooling capacity so as to change the temperature of the liquid medium.

* * * * *